US007626336B2

(12) United States Patent
Hai et al.

(10) Patent No.: US 7,626,336 B2
(45) Date of Patent: Dec. 1, 2009

(54) PLASMA DISPLAY PANEL AND METHOD FOR PRODUCING SAME

(75) Inventors: Lin Hai, Yamanashi-ken (JP); Taro Naoi, Yamanashi-ken (JP); Atsushi Hirota, Yamanashi-ken (JP); Takeshi Sasaki, Yamanashi-ken (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 363 days.

(21) Appl. No.: 10/573,446

(22) PCT Filed: Sep. 17, 2004

(86) PCT No.: PCT/JP2004/013641

§ 371 (c)(1),
(2), (4) Date: Mar. 24, 2006

(87) PCT Pub. No.: WO2005/031782

PCT Pub. Date: Apr. 7, 2005

(65) Prior Publication Data

US 2007/0013306 A1 Jan. 18, 2007

(30) Foreign Application Priority Data

| | | |
|---|---|---|
| Sep. 26, 2003 | (JP) | 2003-335866 |
| Feb. 26, 2004 | (JP) | 2004-052193 |
| Feb. 26, 2004 | (JP) | 2004-052194 |
| Jul. 21, 2004 | (JP) | 2004-212959 |
| Jul. 21, 2004 | (JP) | 2004-212960 |
| Sep. 9, 2004 | (JP) | 2004-262988 |
| Sep. 9, 2004 | (JP) | 2004-262989 |

(51) Int. Cl.
*H01J 17/49* (2006.01)

(52) U.S. Cl. ..... 313/587; 313/582; 313/583; 313/584; 313/585; 313/586

(58) Field of Classification Search ..... 313/581–587
See application file for complete search history.

(56) References Cited

U.S. PATENT DOCUMENTS

| | | | | |
|---|---|---|---|---|
| 4,604,118 | A * | 8/1986 | Bocko et al. | 65/416 |
| 5,039,509 | A | 8/1991 | Miyata et al. | |
| 6,013,309 | A | 1/2000 | Kim et al. | |
| 6,379,783 | B1 | 4/2002 | Kim et al. | |
| 6,674,238 | B2 | 1/2004 | Otani et al. | |

(Continued)

FOREIGN PATENT DOCUMENTS

| | | |
|---|---|---|
| EP | 1 221 711 | 7/2002 |

(Continued)

OTHER PUBLICATIONS

European Search Report dated Feb. 27, 2009.

*Primary Examiner*—Nimeshkumar D. Patel
*Assistant Examiner*—Thomas A Hollweg
(74) *Attorney, Agent, or Firm*—McGinn IP Law Group PLLC

(57) ABSTRACT

An MgO layer (8) including an MgO crystal causing a cathode-luminescence emission having a peak within a range from 230 nm to 250 nm upon being excited by electron beams is provided in a position facing a discharge cell (C) formed in the discharge space between the front glass substrate (1) and the back glass substrate (4).

35 Claims, 18 Drawing Sheets

SECTION V1-V1

U.S. PATENT DOCUMENTS

| | | | | |
|---|---|---|---|---|
| 6,788,373 | B2 | 9/2004 | Ito et al. | |
| 6,821,616 | B1 * | 11/2004 | Sakurai et al. | 428/332 |
| 2001/0050528 | A1 | 12/2001 | Sawada et al. | |
| 2002/0036466 | A1 | 3/2002 | Tanaka et al. | |

FOREIGN PATENT DOCUMENTS

| | | | |
|---|---|---|---|
| EP | 1 298 694 | | 4/2003 |
| EP | 1 316 937 | | 6/2003 |
| JP | 6-325696 | | 11/1994 |
| JP | 7-37510 | | 2/1995 |
| JP | 07-192630 | | 7/1995 |
| JP | 7-192630 | | 7/1995 |
| JP | 7-296718 | | 11/1995 |
| JP | 8-287823 | | 11/1996 |
| JP | 08-287823 | | 11/1996 |
| JP | 9-167566 | | 6/1997 |
| JP | 10/233157 | | 9/1998 |
| JP | 2000-156153 | | 6/2000 |
| JP | 2001-76629 | | 3/2001 |
| JP | 2001-076629 | | 3/2001 |
| JP | 2002-033053 | | 1/2002 |
| JP | 2002-33053 | | 1/2002 |
| JP | 2002150953 | A * | 5/2002 |
| JP | 2003-31130 | | 1/2003 |

* cited by examiner

FIRST EMBODIMENT EXAMPLE

SECTION V1-V1

SECTION V2-V2

SECTION W1-W1

SINGLE CRYSTAL OF CUBIC SINGLE-CRYSTAL STRUCTURE

SINGLE CRYSTAL OF CUBIC POLYCRYSTAL STRUCTURE

DISCHARGE PROBABILITIES(REST TIME 1000 $\mu sec^{-1}$)

| | ACTUAL MEASUREMENT | NORMALIZATION1 | NORMALIZATION2 |
|---|---|---|---|
| POLYCRYSTAL STRUCTURE MgO | 89.8 | 826.4 | 39.09 |
| VAPOR-DEPOSITED MgO | 2.3 | 21.1 | 1.00 |
| NO MgO | 0.1 | 1.0 | 0.05 |

DISCHARGE DELAY(REST TIME 1000 μsec)

| | ACTUAL MEASUREMENT | NORMALIZATION1 | NORMALIZATION2 |
|---|---|---|---|
| POLYCRYSTAL STRUCTURE MgO | 0.5 | 0.01 | 0.12 |
| VAPOR-DEPOSITED MgO | 4.0 | 0.06 | 1.00 |
| NO MgO | 65.0 | 1.00 | 16.25 |

SECOND EMBODIMENT EXAMPLE

SECTION V3-V3

SECTION W2-W2

THIRD EMBODIMENT EXAMPLE

SECTION V4-V4

SECTION W3-W3

PLASMA DISPLAY PANEL AND METHOD FOR PRODUCING SAME

TECHNICAL FIELD

This invention relates to plasma display panels and a method of manufacturing the plasma display panels.

BACKGROUND ART

A surface-discharge-type alternating-current plasma display panel (hereinafter referred to as "PDP") has two opposing glass substrates placed on either side of a discharge-gas-filled discharge space, row electrode pairs extending in the row direction and regularly arranged in the column direction on one of the glass substrates, column electrodes extending in the column direction and regularly arranged in the row direction on the other glass substrate, and unit light emission areas (discharge cells) thus formed in matrix form in positions corresponding to the intersections between the row electrode pairs and the column electrodes in the discharge space.

Further, in the PDP, a magnesium oxide (MgO) film, which has the function of protecting the dielectric layer and the function of emitting secondary electrons into the unit light emission area, is formed on a portion of a dielectric layer facing the unit light emission areas, the dielectric layer being provided for covering the row electrodes or the column electrodes.

As a method for forming the MgO film in the manufacturing process for PDPs as described above, the adoption of a screen printing technique of applying a coating of a paste containing an MgO powder mixture onto a dielectric layer is considered on the grounds of simplicity and convenience as described in Japanese unexamined patent publication No. 6-325696, for example.

However, in the case of using a paste containing a polycrystalline floccule type magnesium oxide obtained by heat-treating and purifying magnesium hydroxide, to form an MgO film of the PDP by a screen printing technique as described in Japanese unexamined patent publication No. 6-325696, the resulting discharge characteristics of the PDP are merely largely equal to or slightly greater than those provided in the case of using an evaporation technique to form the magnesium oxide film.

An urgent need arising from this is to form an MgO film capable of yielding a greater improvement in the discharge characteristics in the PDP.

An object of the present invention is to solve the problem associated with PDPs having a conventional magnesium oxide film formed therein as described above.

DISCLOSER OF THE INVENTION

Problems to be Solved by the Invention

To attain the above object, a PDP according to the invention (invention described in claim 1), which is equipped with a front substrate and a back substrate facing each other across a discharge space, and with, between the front substrate and the back substrate, a plurality of row electrode pairs and a plurality of column electrodes extending in a direction intersecting the row electrode pairs to form unit light emitting areas in the respective portions of the discharge space corresponding to the intersections with the row electrode pairs, is characterized by providing, on an area facing the unit light emitting area between the front substrate and the back substrate, a magnesium oxide layer that includes a magnesium oxide crystal causing a cathode-luminescence emission having a peak within a wavelength range of 200 nm to 300 nm upon being excited by electron beams.

The magnesium oxide layer provided in areas facing the discharge cells includes magnesium oxide crystals causing a cathode-luminescence emission having a peak within a wavelength range of 200 nm to 300 nm upon excitation by electron beams. Thereby, the above PDP is improved in the discharge characteristics such as the discharge probability and the discharge delay in the PDP and thus is capable of providing satisfactory discharge characteristics.

Further, to attain the aforementioned object, a method of manufacturing a PDP according to the invention (invention described in claim 18) is a method of manufacturing a plasma display panel which is equipped with a front substrate and a back substrate facing each other across a discharge space, electrodes formed on at least one of the front and back substrates, a dielectric layer covering the electrodes, and a protective layer covering the dielectric layer, and is characterized by having a process of forming a magnesium oxide layer that includes a magnesium oxide crystal causing a cathode-luminescence emission having a peak within a wavelength range of 200 nm to 300 nm upon being excited by electron beams, in a position covering a required portion of the dielectric layer.

With the above method of manufacturing the PDPs, in between the front substrate and the back substrate facing each other across the discharge space of the PDP, on a required portion of the dielectric layer, the magnesium oxide layer covering the dielectric layer is formed of magnesium oxide crystals causing a cathode-luminescence emission having a peak within a wavelength range of 200 nm to 300 nm upon excitation by electron beams. Thereby, the discharge characteristics such as the discharge probability and the discharge delay in the PDP are improved and it becomes possible to provide satisfactory discharge characteristics.

BEST MODE FOR CARRYING OUT THE INVENTION

Figure 1:
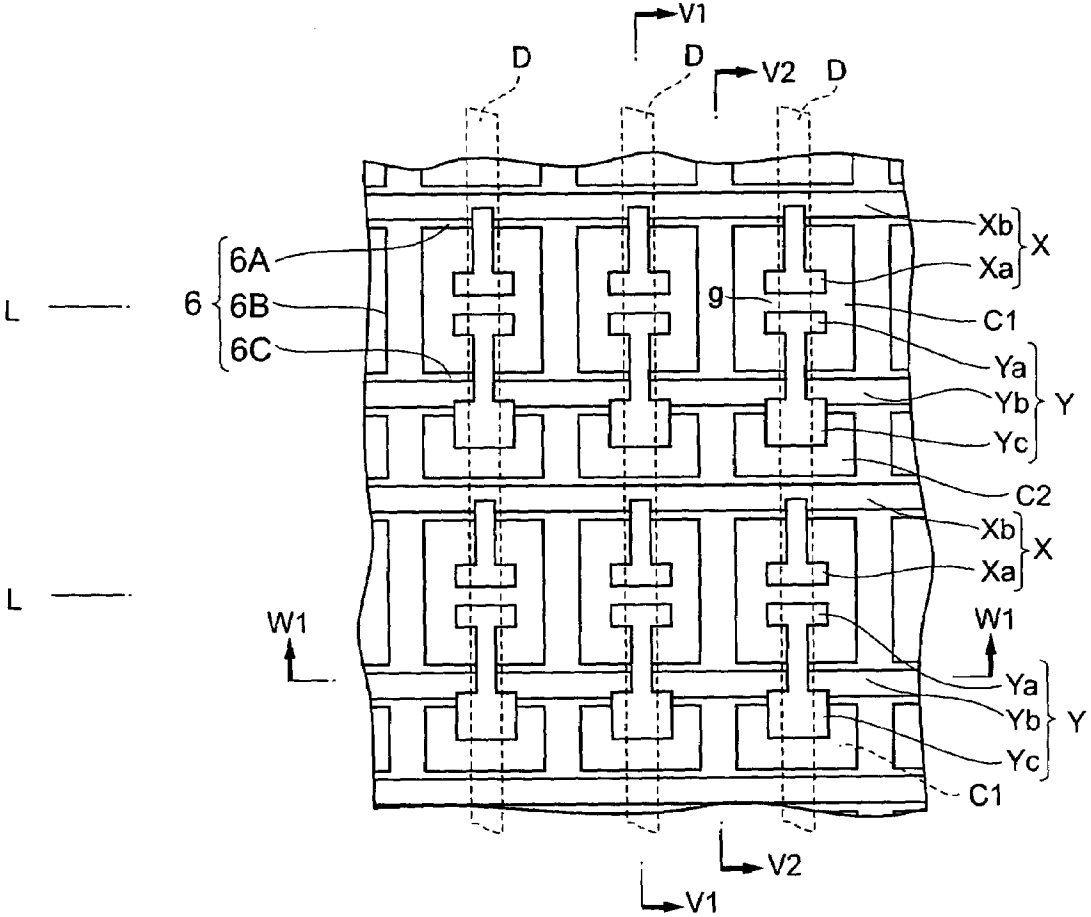
FIG. 1 is a front view illustrating a first embodiment example of an embodiment of the invention.

This invention will be described below in detail on the basis of embodiment examples illustrated in the drawings.

FIRST EMBODIMENT EXAMPLE

FIGS. 1 to 4 illustrate a first embodiment example in an embodiment of the invention.

Figure 2:
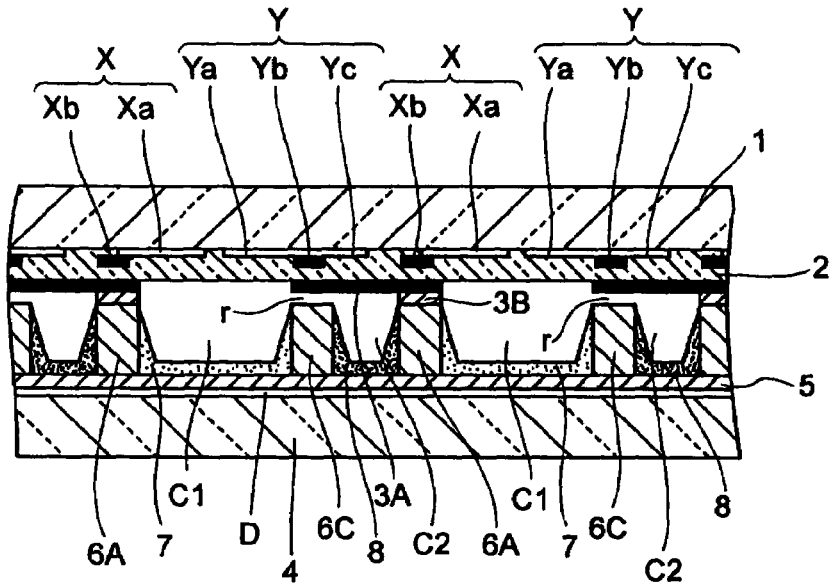
FIG. 2 is a sectional view taken along the V1-V1 line in FIG. 1.
Figure 3:
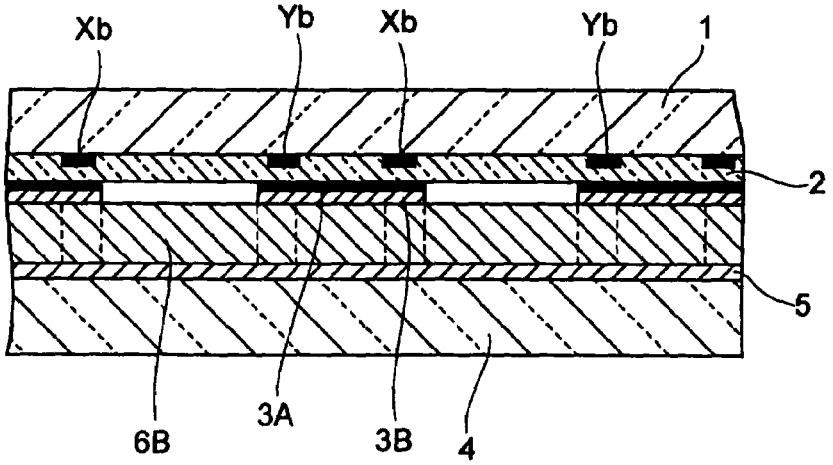
FIG. 3 is a sectional view taken along the V2-V2 line in FIG. 1.
Figure 4:
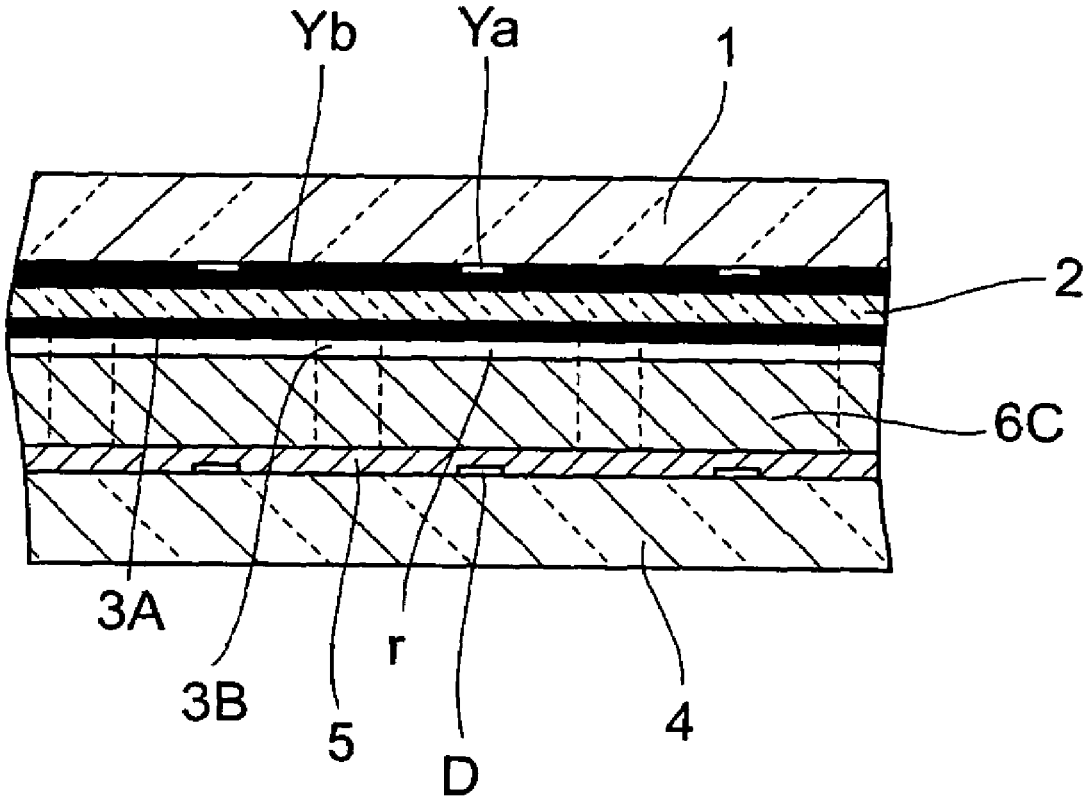
FIG. 4 is a sectional view taken along the W1-W1 line in FIG. 1.

FIG. 1 is a schematic front view of the cell structure of a surface-discharge-type AC PDP in the first embodiment example. FIG. 2 is a sectional view taken along the V1-V1 line in FIG. 1, FIG. 3 is a sectional view taken along the V2-V2 line in FIG. 1, and FIG. 4 is a sectional view taken along the W1-W1 line in FIG. 1.

The PDP in FIGS. 1 to 4 has a plurality of row electrode pairs (X, Y) extending in the row direction (the right-left direction in FIG. 1) of a front glass substrate 1 and regularly arranged in the column direction (the up-down direction in FIG. 1) on the rear-facing face of the front glass substrate 1 serving as the display surface.

A row electrode X is composed of T-shaped transparent electrodes Xa formed of a transparent conductive film made of ITO or the like, and a black bus electrode Xb which is formed of a metal film and which extends in the row direction of the front glass substrate 1 and is connected to the narrow proximal ends of the transparent electrodes Xa.

A row electrode Y, likewise, is composed of: T-shaped transparent electrodes Ya formed of a transparent conductive film made of ITO or the like; a black bus electrode Yb which is formed of a metal film, and which extends in the row direction of the front glass substrate 1 and is connected to the narrow proximal ends of the transparent electrodes Ya; and address-discharge transparent electrodes Yc each formed integrally with the transparent electrode Ya to extend out from the proximal end of the transparent electrode Ya toward the opposite side of the bus electrode Yb from the transparent electrode Ya.

The row electrodes X and Y are arranged in alternate positions in the column direction of the front glass substrate 1 (the vertical direction in FIG. 1 and the right-left direction in FIG. 2). The transparent electrodes Xa and Ya, which are regularly spaced along the associated bus electrodes Xb and Yb, each extend out toward their counterparts in the row electrode pair, so that the wide distal ends of the transparent electrodes Xa and Ya face each other across a discharge gap g of a required width.

Then, an address-discharge transparent electrode Yc of the row electrode Y is placed between the bus electrode Yb of this row electrode Y and the bus electrode Xb of the row electrode X which is of the adjacent row electrode pair (X, Y) in the column direction and is positioned back to back with and away from the bus electrode Yb.

A display line L extending in the row direction is formed in each row electrode pair (X, Y).

A dielectric layer 2 is formed on the rear-facing face of the front glass substrate 1 so as to cover the row electrode pairs (X, Y). Black or dark colored first additional dielectric layers 3A projecting backward (downward in FIG. 2) from the dielectric layer 2 are formed on the rear-facing face of the dielectric layer 2 so as to each extend, in parallel to the back-to-back bus electrodes Xb and Yb of the adjacent row electrode pairs (X, Y) in the row direction, along a position opposite to these bus electrodes Xb and Yb and the area between the back-to-back bus electrodes Xb and Yb (the area in which the address-discharge transparent electrodes Yc).

Further, a second additional dielectric layer 3B projecting backward (downward in FIG. 2) from the first additional dielectric layer 3A is formed on a portion of the rear-facing face of the first additional dielectric layer 3A opposite to the bus electrode Xb so as to extend parallel to the bus electrode Xb.

A protective layer, not diagrammed, made of magnesium oxide (MgO) covers the surface of the rear-facing faces of the dielectric layer 2, first additional dielectric layers 3A and second additional dielectric layers 3B.

The front glass substrate 1 is placed in parallel to the back glass substrate 4 across the discharge space, and on the face of the back glass substrate 4 facing toward the front glass substrate 1, a plurality of column electrodes D are arranged in parallel to each other at predetermined intervals so as to each extend in a direction at right angles to the bus electrodes Xb, Yb (the column direction) through positions opposite to the paired transparent electrodes Xa and Ya in each row electrode pair (X, Y).

Further, a column-electrode protective layer (dielectric layer) 5 covering the column electrodes D is formed on the face of the back glass substrate 4 facing toward the front glass substrate 1. A partition unit 6 shaped as described below in detail is formed on the column-electrode protective layer 5.

Specifically, when viewed from the front glass substrate 1, the partition unit 6 is constituted of first lateral walls 6A each extending in the row direction along a position opposite to the bus electrode Xb of each row electrode X, vertical walls 6B each extending in the column direction in a strip between the transparent electrodes Xa, Ya which are regularly spaced along the associated bus electrodes Xb, Yb of the row electrodes X, Y, and second lateral walls 6C each extending parallel to the first lateral wall 6A at a required interval along a position opposite the bus electrode Yb of each row electrode Y.

Then, the height of the first lateral wall 6A, the vertical wall 6B and the second lateral wall 6C is set equal to the distance between the protective layer covering the rear-facing face of the second additional dielectric layers 3B and the column-electrode protective layer 5 covering the column electrodes D.

Thereby, the front-facing face (the upper face in FIG. 2) of the first lateral walls 6A of the partition unit 6 is in contact with the protective layer covering the second additional dielectric layers 3B.

The first lateral walls 6A, the vertical walls 6B and the second lateral walls 6C of the partition unit 6 partition the space between the front glass substrate 1 and the back glass substrate 4 into areas each corresponding to the paired transparent electrodes Xa and Ya opposite each other to form display discharge cells (first light-emission areas) C1. Further, part of the space, which is sandwiched between the first lateral wall 6A and the second lateral wall 6C and is opposite to the area between the back-to-back bus electrodes Xb and Yb of the row electrode pairs (X, Y) adjacent to each other, is partitioned by the vertical walls 6B to thereby form address discharge cells (second light emission areas) C2 each alternating with the display discharge cells C1 in the column direction.

The address discharge cell C2 is placed opposite the address-discharge transparent electrode Yc of the row electrode Y.

Further, the display discharge cell C1 and the address discharge cell C2, which are adjacent to each other across the second lateral wall 6C in the column direction, communicate with each other by means of a clearance r that is formed between the protective layer covering the first additional dielectric layer 3A and the second lateral wall 6C.

A phosphor layer 7 is formed on the surface of the column-electrode protective layer 5 and the side faces of the first lateral wall 6A, the vertical walls 6B and the second lateral wall 6C of the partition unit 6 which face toward the discharge space in each display discharge cell C1, so as to cover approximately all the five faces. The arrangement of the colors of the phosphor layers 7 is red (R), green (G) and blue (B) in sequence in the row direction in the respective display discharge cells C1.

In addition, a magnesium oxide (MgO) layer 8, which includes magnesium oxide crystals causing a cathode-luminescence emission (CL emission) having a peak within a wavelength range of 200 nm to 300 nm upon excitation by electron beams, as described later in detail, is formed on the surface of the column-electrode protective layer 5 and the side faces of the first lateral wall 6A, the vertical walls 6B and the second lateral wall 6C of the partition unit 6 which face toward the discharge space in each address discharge cell C2, so as to cover approximately all the five faces.

The display discharge cells C1 and the address discharge cells C2 are filled with a discharge gas including xenon.

The MgO layer 8 of the foregoing PDP is formed of the following materials and by the following method.

Figure 5:
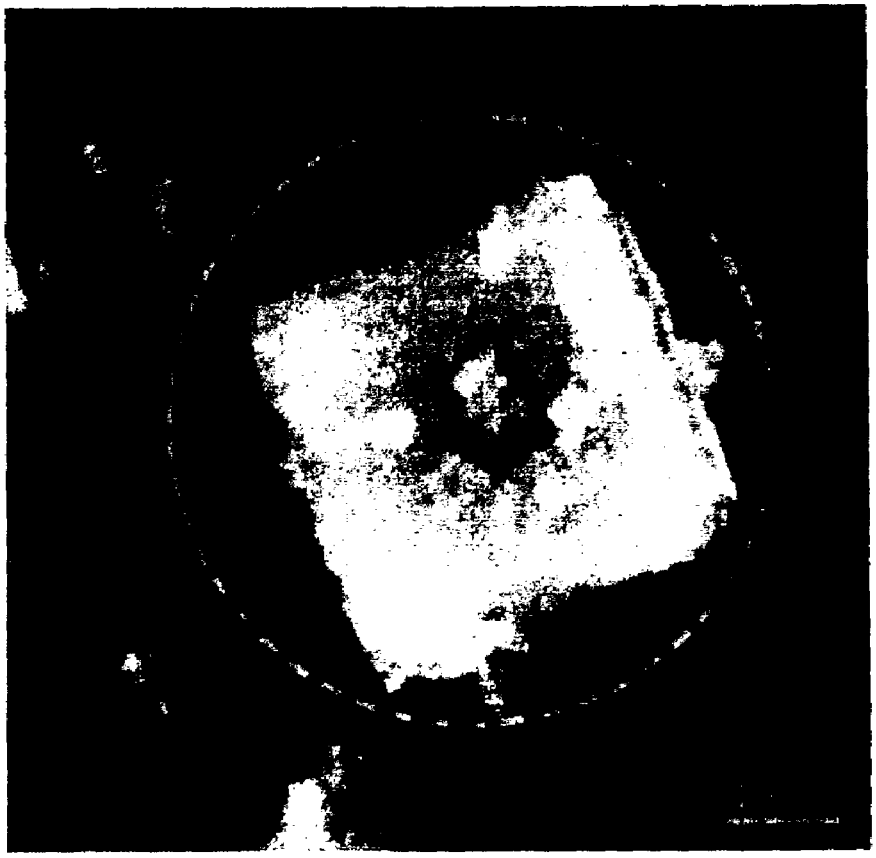
FIG. 5 is a SEM photograph of a magnesium oxide single crystal having a cubic single-crystal structure.
Figure 6:
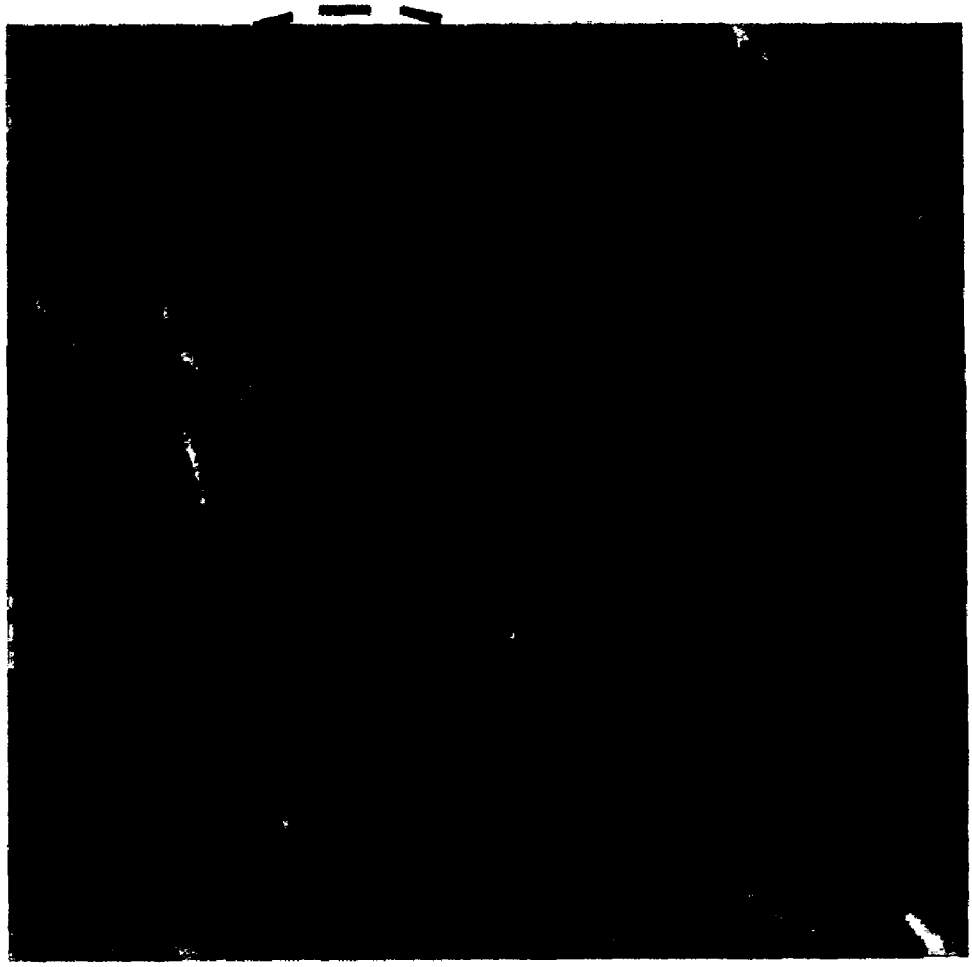
FIG. 6 is a SEM photograph of a magnesium oxide single crystal having a cubic polycrystal structure.

Specifically, included among MgO crystals which are used as materials for forming the MgO layer 8 and cause CL emission having a peak within a wavelength range of 200 nm to 300 nm upon being excited by an electron beam, is, for example, a single crystal of magnesium which is obtained by performing vapor-phase oxidation on magnesium steam generated by heating magnesium (this single crystal of magnesium is hereinafter referred to as "vapor-phase MgO single crystal"). As the vapor-phase MgO single crystal, an MgO single crystal having a cubic single-crystal structure as illustrated in the SEM photograph in FIG. 5, and an MgO single crystal having a structure of cubic crystals fitted to each other (i.e. a cubic polycrystal structure) as illustrated in the SEM photograph in FIG. 6 are included for example.

The vapor-phase MgO single crystal contributes to an improvement of the discharge characteristics such as a reduction in discharge delay as described later.

Further, as compared with magnesium oxide obtained by other methods, the vapor-phase magnesium oxide single crystal has the features of being of a high purity, taking a microscopic particle form, causing less particle agglomeration, and the like.

The vapor-phase MgO single crystal used in the embodiment example has an average particle diameter of 500 or more angstroms (preferably, 2000 or more angstroms) based on a measurement using the BET method.

The MgO layer 8 is formed by use of a method such as screen printing, offset printing, dispenser technique, ink-jet technique, roll-coating technique to apply coating of a paste including vapor-phase magnesium oxide single crystals as described above to the surface of the column-electrode protective layer 5 and the side faces of the first lateral wall 6A, the vertical walls 6B and the second lateral wall 6C of the partition unit 6 facing toward the discharge space in each address discharge cell C2, or alternatively by use of a method such as spraying techniques, electrostatic spraying techniques to cause the vapor-phase magnesium oxide single crystals to adhere to the same.

In the foregoing PDP, when an image is generated, after a reset discharge is produced in the display discharge cell C1 and the address discharge cell C2, an address discharge is initiated between the address-discharge transparent electrode Yc of the row electrode and the column electrode D in the address discharge cell C2.

Charged particles thus generated through the address discharge in the address discharge cell C2 are introduced through the clearance r between the first additional dielectric layer 3A and the second lateral wall 6C into the display discharge cell C1. The display discharge cells C1 (light emission cells) having wall charges generated due to the charged particles and the display discharge cells C1 (non-light emission cells) having no wall charge generated are distributed over the panel face in accordance with the image to be formed.

Then, after the address discharge, a sustaining discharge is initiated between the transparent electrode Xa and the transparent electrode Ya of the row electrode pair (X, Y) in each light emission cell, thereby causing the red (R), green (G) and blue (B) phosphor layers 7 to emit light to form the image on the panel face.

The foregoing PDP is designed such that the address discharge is produced in the address discharge cell C2 that is partitioned off from the display discharge cell C1 in which the sustaining discharge is produced for causing the phosphor layer 7 to emit light. This makes it possible to provide stable address-discharge characteristics because the address discharge has no chance of being subject to effects originating in the phosphor layer, such as discharge characteristics varying according to the color of the phosphor materials and variations in the thickness of the phosphor layers occurring in the manufacturing process.

Further, in the foregoing PDP, when the reset discharge is initiated prior to the address discharge, a discharge occurs in the address discharge as well. At this point, because the MgO layer 8 is formed in the address discharge cell C2, the priming effect caused by the reset discharge lasts for a long time, thereby speeding up in the address discharge.

Figure 7:
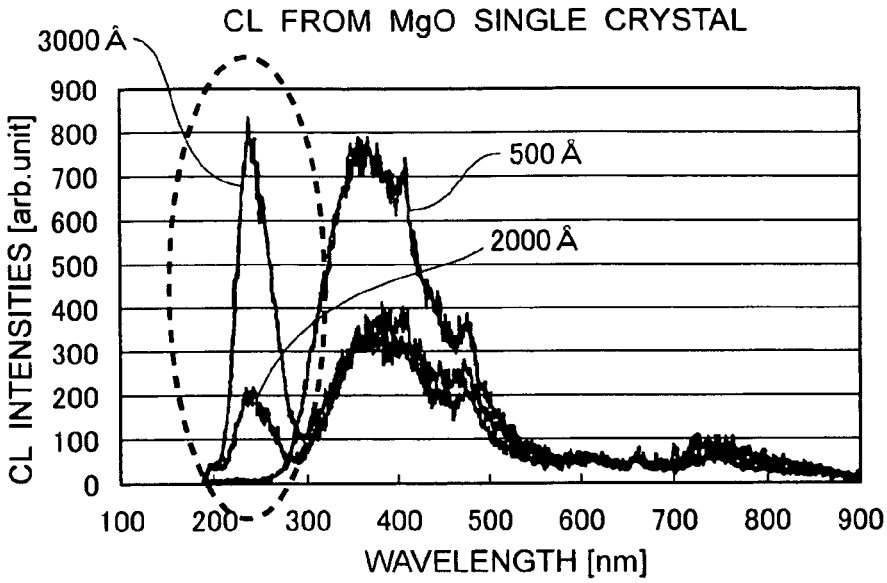
FIG. 7 is a graph showing the relationship between the particle diameters of magnesium oxide single crystals and the wavelengths of CL emission in the first embodiment example.
Figure 8:
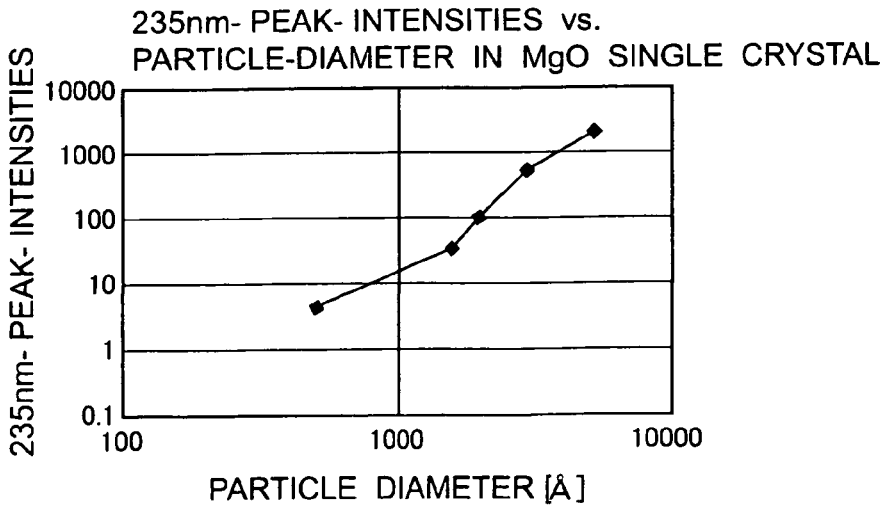
FIG. 8 is a graph showing the relationship between the particle diameters of magnesium oxide single crystals and the peak intensities of CL emission at 235 nm in the same example.

Further, in the foregoing PDP, because the MgO layer 8 is formed in the address discharge cell C2, as shown in FIGS. 7 and 8, the application of electron beam excites, in addition to a CL (cathode-luminescence) emission having a peak within a wavelength range of 300 nm to 400 nm, a CL emission having a peak within a wavelength range of 200 nm to 300 nm (in particular, around 235 nm, of 230 nm to 250 nm) from the large-particle-diameter vapor-phase MgO single crystals included in the MgO layer 8.

Figure 9:
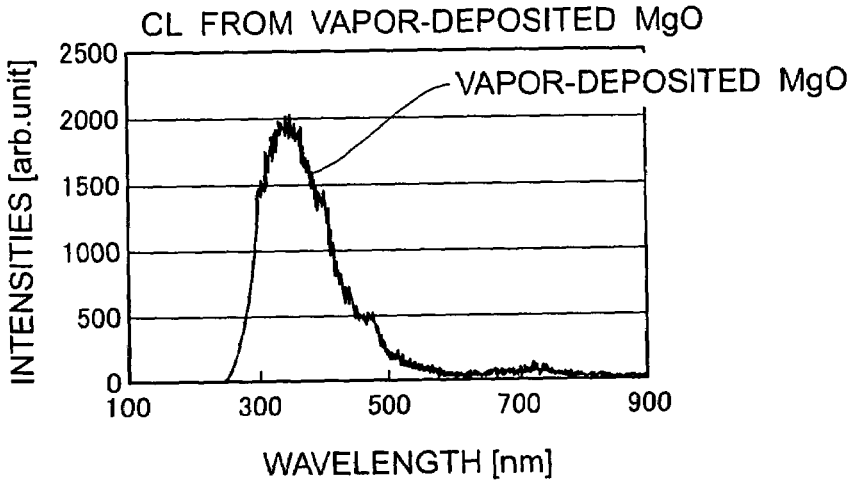
FIG. 9 is a graph showing the state of the wavelength of CL emission from the magnesium oxide layer formed by vapor deposition.

As shown in FIG. 9, the CL emission with a peak within a wavelength range of 200 nm to 300 nm (in particular, around 235 nm, of 230 nm to 250 nm) is not excited from a MgO layer formed typically by vapor deposition, but only a CL emission having a peak wavelengths from 300 nm to 400 nm is excited.

Further, as seen from FIGS. 7 and 8, the greater the particle diameter of the vapor-phase MgO single crystal, the stronger the peak intensity of the CL emission having a peak within the wavelength range from 200 nm to 300 nm (in particular, 235 nm).

For the sake of reference, the BET specific surface area (s) is measured by a nitrogen adsorption method, and the particle diameter ($D_{BET}$) of the vapor-phase MgO single crystals forming the MgO layer 8 is calculated from the measured value by the following equation.

$$D_{BET}=A/s\times\rho,$$

where

A: shape count (A=6)

ρ: real density of magnesium.

Figure 10:
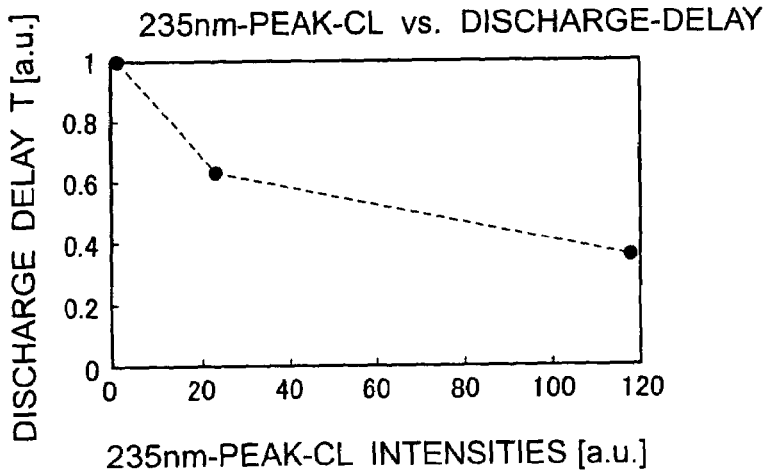
FIG. 10 is a graph showing the relationship between the discharge delay and the peak intensities of CL emission at 235 nm from the magnesium oxide single crystals.

FIG. 10 is a graph showing the correlation between the CL emission intensities and the discharge delay.

It is seen from FIG. 10 that the discharge delay in the PDP is shortened by the 235 nm CL emission excited from the MgO layer 8, and further, as the intensity of the 235 nm CL emission increases, the discharge delay is shortened.

As described hitherto, the foregoing PDP is capable of providing satisfactory discharge characteristics as a result of the formation of the MgO layer 8 including the vapor-phase MgO single crystals of an average particle diameter of 500 or more angstroms (preferably, 2000 or more angstroms) measured by the BET method, for the purpose of an improvement of the discharge characteristics (a reduction in discharge delay, an increase in the discharge probability).

Figures 11, 12:
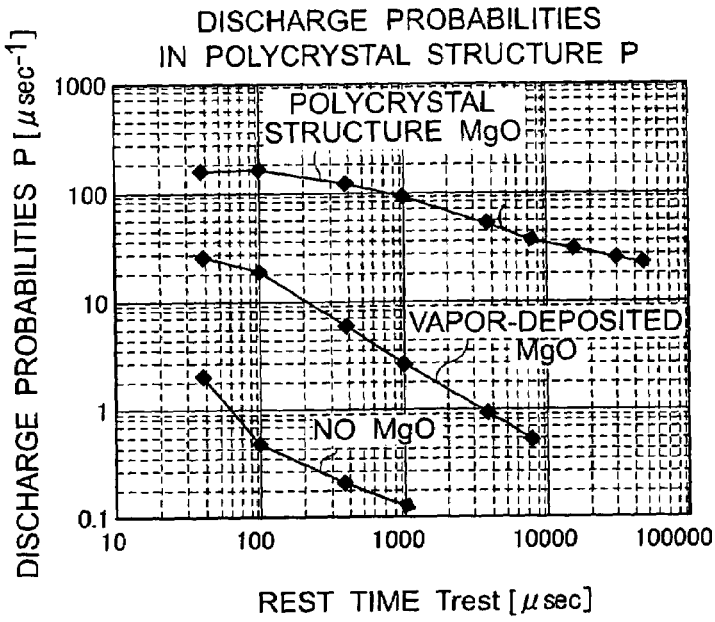
FIG. 11 is a graph showing the improved state of the discharge probability in the same example.
FIG. 12 is a table showing the improved state of the discharge probability in the same example.

FIG. 11 is a graph of the comparison of the discharge probabilities in the cases where the MgO layer 8 to be provided in the address discharge cell C2 is formed by application of coating of a paste including the vapor-phase MgO single crystals of an average particle diameter ranging from 2000 to 3000 angstroms, where an MgO layer is formed by conventional vapor deposition techniques, and where no MgO layer is formed. FIG. 12 shows the discharge probabilities in the cases in FIG. 11 when the rest time of the discharge is 1000 μsec.

Figures 13, 14:
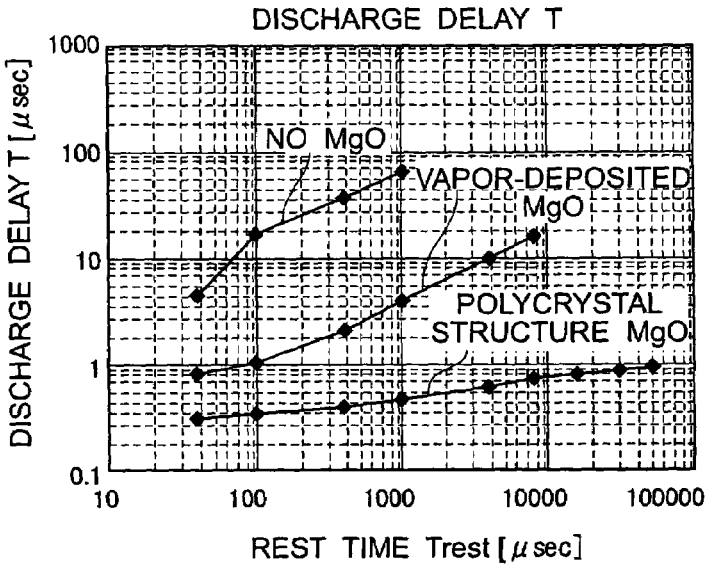
FIG. 13 is a graph showing the improved state of the discharge delay in the same example.
FIG. 14 is a table showing the improved state of the discharge delay in the same example.

Further, similarly, FIG. 13 is a graph of the comparison of the discharge delay times in the cases where the MgO layer 8 is formed by application of a coating of a paste including the vapor-phase MgO single crystals of an average particle diameter ranging from 2000 to 3000 angstroms, where an MgO layer is formed by conventional vapor deposition techniques, and where no MgO layer is formed. FIG. 14 shows the discharge delay times in the cases in FIG. 13 when the rest time of the discharge is 1000 μsec.

Note that FIGS. 11 to 14 show the case where vapor-phase MgO single crystals of a polycrystal structure are included in the MgO layer 8.

It is seen from FIGS. 11 to 14 that the provision of the MgO layer 8 including the vapor-phase MgO single crystals causes a significant improvement in the discharge probability and the discharge delay in the foregoing PDP and further causes a reduction in the dependence of discharge delay on rest time, leading to satisfactory discharge characteristics.

Figure 15:
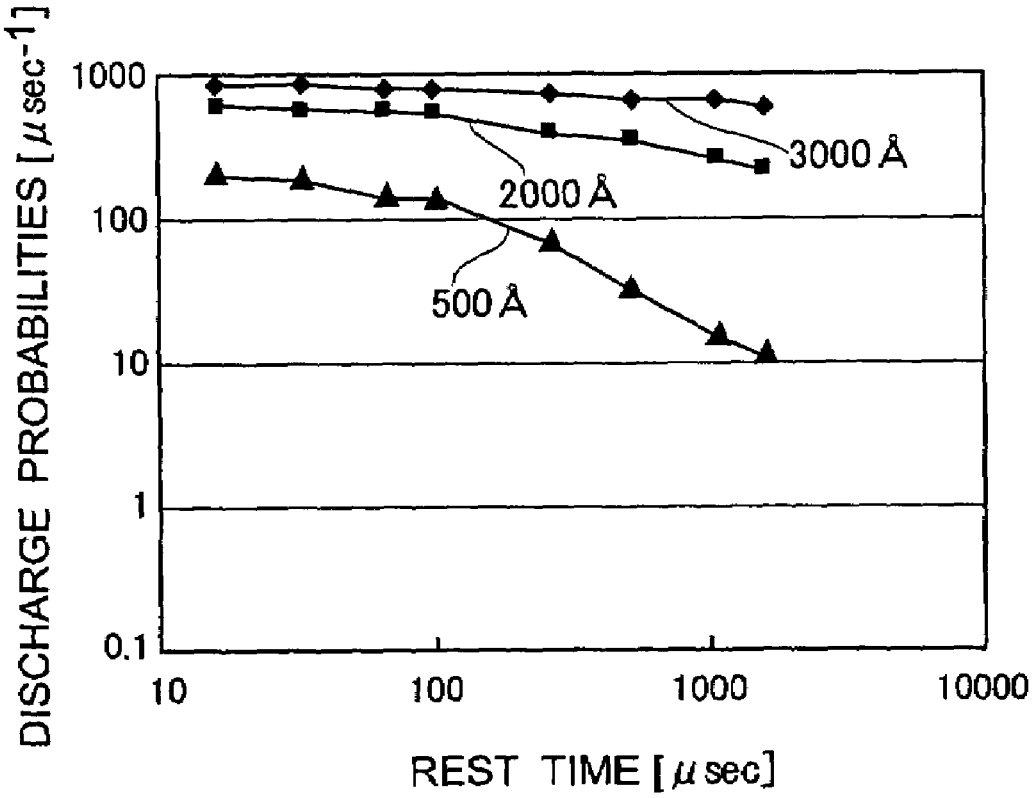
FIG. 15 is a graph showing the relationship between the particle diameters of magnesium oxide single crystals and the discharge probability in the same example.

FIG. 15 is a graph showing the relationship between the discharge probabilities and the particle diameters of the vapor-phase MgO single crystals forming the MgO layer 8.

It is seen from FIG. 15 that the greater the particle diameter of the vapor-phase MgO single crystal forming the MgO layer 8, the higher the discharge probability, and the MgO layer 8, which is formed of the vapor-phase MgO single crystals of a particle diameter (2000 angstroms and 3000 angstroms in the examples shown in the figure) exciting a CL emission having a peak at 235 nm as described earlier, effects a significant improvement in discharge probability.

More specifically, the conjectured reason for the improvement of the discharge characteristics caused by the MgO layer 8 in the PDP as described above is because the vapor-phase MgO single crystals causing the CL emission having a peak within the wavelength range from 200 nm to 300 nm (in particular, around 235 nm, of 230 nm to 250 nm) have an energy level corresponding to the peak wavelength, so that the energy level enables the trapping of electrons for a long time (some msec. or more), and the trapped electrons are extracted by an electric field so as to serve as the primary electrons required for starting a discharge.

Also, because of the correlation between the intensity of the CL emission and the particle diameter of the vapor-phase MgO single crystals, the stronger the intensity of the CL emission having a peak within the wavelength range from 200 nm to 300 nm (in particular, around 235 nm, of 230 nm to 250 nm), the greater the improvement effect of the discharge characteristics caused by the vapor-phase MgO single crystal.

In other words, for the deposition of vapor-phase MgO single crystals of a large particle diameter, an increase in the heating temperature for generating magnesium vapor is required. Because of this, the length of the flame with which magnesium and oxygen react increases, and therefore the temperature difference between the flame and the surrounding ambience increases. It is thus conceivable that the larger the particle size of the vapor-phase MgO single crystal, the greater the number of energy levels occurring in correspondence with the peak wavelengths (e.g. around 235 nm, within a range from 230 nm to 250 nm) of the CL emission as described earlier.

In a further conjecture regarding the vapor-phase MgO single crystal of a cubic polycrystal structure, many plane defects occur and the presence of energy levels arising from these plane defects contributes to an improvement in discharge probability.

For the sake of reference, it is seen from FIG. 15 that the discharge probability is greatly enhanced even when the MgO layer 8 is formed by the application of a coating of a paste including vapor-phase MgO single crystals of an average particle diameter of the order of 500 angstroms by use of a method such as a screen printing technique, an offset printing technique, a dispenser technique, an ink-jet technique or a roll-coating technique, as compared with that in conventional vapor-deposited MgO layers.

Further, the above-described results in FIGS. 7 to 15 are obtained when the MgO layer 8 is formed by the application of a coating of a paste including vapor-phase MgO single crystals by use of a method such as a screen printing technique, a nozzle coating or an ink-jet technique, but the MgO layer 8 may be formed of a powder layer resulting from deposition of the powder of vapor-phase MgO single crystals by use of a method such as a spraying technique or an electrostatic coating technique.

Further, the above embodiment example illustrates the case of forming the MgO layer 8 by applying a coating of a paste including vapor-phase single crystals to the interior of the address discharge cell. However, a paste including MgO single crystals may be applied so as to cover the dielectric layer 2 provided on the front substrate to form a protective layer.

Further, a conventional MgO film may be formed on the dielectric layer 2 on the front substrate by vapor deposition, and then the MgO film may be coated with a paste including the powder of vapor-phase MgO single crystals to form an MgO film as a second layer.

SECOND EMBODIMENT EXAMPLE

Figure 16:
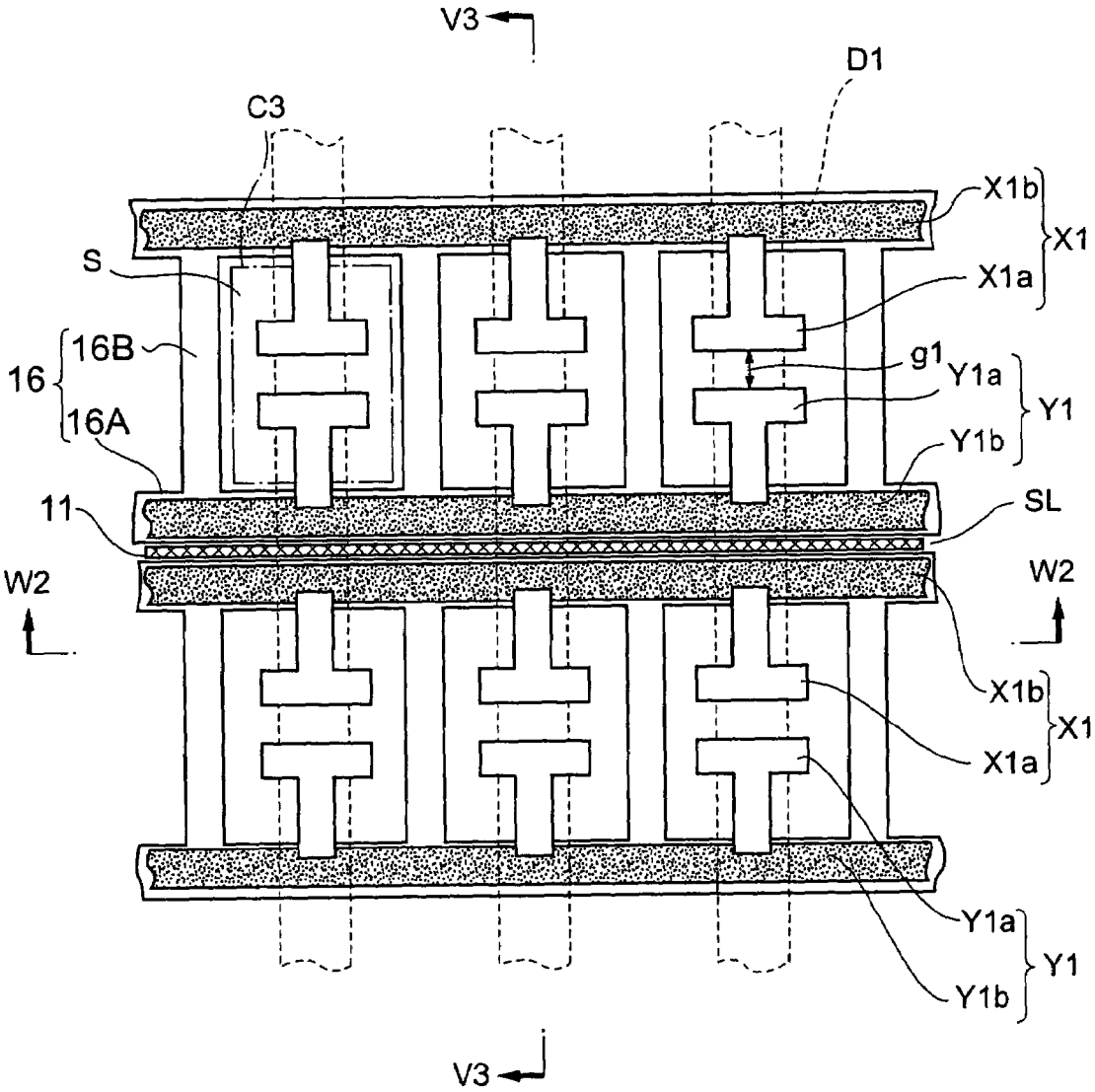
FIG. 16 is a front view illustrating a second embodiment example of an embodiment of the invention.
Figure 17:
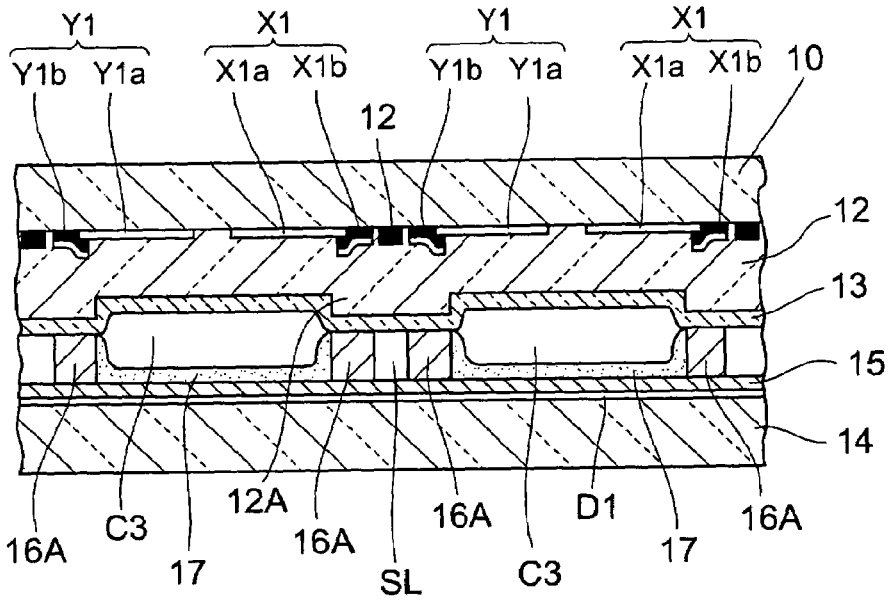
FIG. 17 is a sectional view taken along the V3-V3 line in FIG. 16.
Figure 18:
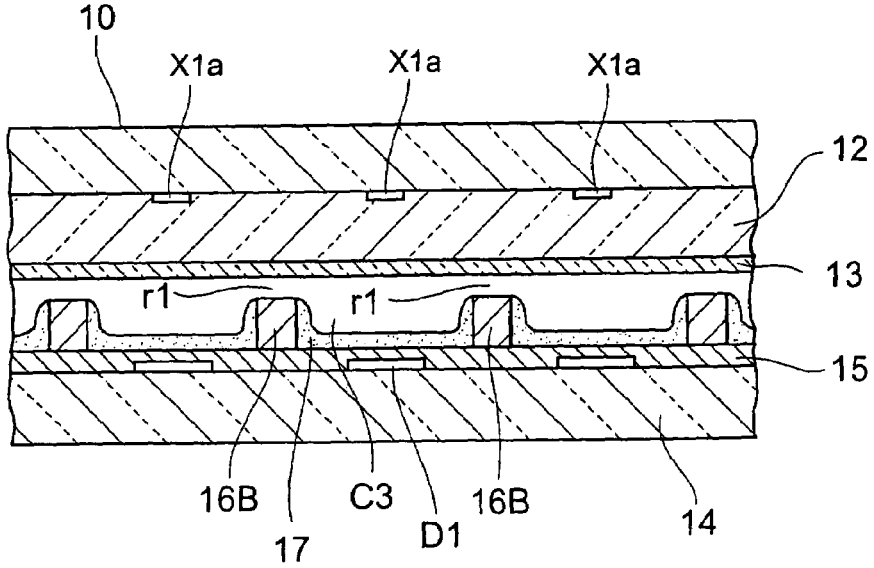
FIG. 18 is a sectional view taken along the W2-W2 line in FIG. 16.

FIGS. 16 to 18 illustrate a second embodiment example of an embodiment of the PDP according to the invention. FIG. 16 is a schematic front view of the PDP in the second embodiment example. FIG. 17 is a sectional view taken along the V3-V3 line in FIG. 16, and FIG. 18 is a sectional view taken along the W2-W2 line in FIG. 16.

The PDP shown in FIGS. 16 to 18 has a plurality of row electrode pairs (X1, Y1) arranged in parallel on a rear-facing face of a front glass substrate 10 serving as the display surface so as to extend in the row direction (the right-left direction in FIG. 16) of the front glass substrate 10.

A row electrode X1 is composed of T-shaped transparent electrodes X1*a* formed of a transparent conductive film made of ITO or the like, and a bus electrode X1*b* which is formed of a metal film and which extends in the row direction of the front glass substrate 10 and is connected to the narrow proximal ends of the transparent electrodes X1*a*.

A row electrode Y1, likewise, is composed of T-shaped transparent electrodes Y1*a* formed of a transparent conductive film made of ITO or the like, and a bus electrode Y1*b* which is formed of a metal film and which extends in the row direction of the front glass substrate 10 and is connected to the narrow proximal ends of the transparent electrodes Y1*a*.

The row electrodes X1 and Y1 are arranged in alternate positions in the column direction of the front glass substrate 10 (the vertical direction in FIG. 16). The transparent electrodes X1*a* and Y1*a*, which are regularly spaced along the associated bus electrodes X1*b* and Y1*b*, each extend out toward their counterparts in the row electrode pair, so that the wide distal ends of the transparent electrodes X1*a* and Y1*a* face each other across a discharge gap g1 of a required width.

Black or dark-colored light absorption layers (light-shield layers) 11 are each formed on the rear-facing face of the front glass substrate 10 between the back-to-back bus electrodes X1*b* and Y1*b* of the row electrode pairs (X1, Y1) adjacent to each other in the column direction, and extend along these bus electrodes X1*b*, Y1*b* in the row direction.

Further, a dielectric layer 12 is formed on the rear-facing face of the front glass substrate 10 so as to cover the row electrode pairs (X1, Y1). On the rear-facing face of the dielectric layer 12, additional dielectric layers 12A, which project backward from the dielectric layer 12, are each formed in a position opposite to the back-to-back bus electrodes X1*b* and Y1*b* of the row electrode pairs (X1, Y1) adjacent to each other and to the area between the above bus electrode X1*b* and the above bus electrode Y1*b* positioned back to back, so as to extend parallel to the bus electrodes X1*b*, Y1*b*.

In turn, on the rear-facing faces of the dielectric layer 12 and the additional dielectric layers 12A, an MgO layer 13, which includes MgO crystals causing a CL emission having a peak within a wavelength range of 200 nm to 300 nm upon excitation by electron beams, as described later, is formed.

On the other hand, on the display-side face of the back glass substrate 14 placed parallel to the front glass substrate 10, column electrodes D1 are arranged in parallel to each other at predetermined intervals so as to extend in a direction at right angles to the row electrode pairs (X1, Y1) (the column direction) through positions opposite to the paired transparent electrodes X1*a* and Y1*a* in each row electrode pair (X1, Y1).

A white column-electrode protective layer 15 covering the column electrodes D1 is further formed on the display-side face of the back glass substrate 14, and in turn partition units 16 are formed on the column-electrode protective layer 15.

Each of the partition units 16 is formed in a ladder shape made up of a pair of transverse walls 16A extending in the row direction in the respective positions opposite to the bus electrodes X1*b* and Y1*b* of each row electrode pair (X1, Y1), and vertical walls 16B each extending in the column direction between the pair of transverse walls 16A in a mid-position between the adjacent column electrodes D1. The partition units 16 are regularly arranged in the column direction on either side of an interstice SL which extends in the row direction between the back-to-back transverse walls 16A of the adjacent partition units 16.

Then, the ladder-shaped partition units 16 partition the discharge space S between the front glass substrate 14 into quadrangular areas each corresponding to the paired transparent electrodes X1*a* and Y1*a* in each row electrode pair (X1, Y1) to form discharge cells C3.

A phosphor layer 17 is formed on the side faces of the transverse walls 16A and the vertical walls 16B of the partition unit 16 and the face of the column-electrode protective layer 15 which face toward each discharge cell C3, so as to cover all these five faces. The arrangement of the colors of the phosphor layers 17 is the three primary colors, red, green and blue, in sequence in the row direction in the respective discharge cells C3.

The MgO layer 13 covering the additional dielectric layers 12A is in contact with the display-side faces of the transparent walls 16A of the partition units 16 (see FIG. 17), whereby each additional dielectric layer 12A blocks off the discharge cell C3 and the interstice SL from each other. However, the display-side face of the vertical wall 16B is out of contact with the MgO layer 13 (see FIG. 18), to form a clearance r1 therebetween, so that the adjacent discharge cells C3 in the row direction communicate with each other by means of the clearance r1.

The discharge space S is filled with a discharge gas including xenon.

As in the case of the first embodiment example, included among MgO crystals used for forming the MgO layer 13, is a single crystal obtained by performing vapor-phase oxidation on magnesium steam generated by heating magnesium by a vapor-phase oxidation technique; for example, a vapor-phase MgO single crystal causing CL emission having a peak within a wavelength range of 200 nm to 300 nm (in particular, 235 nm) upon being excited by an electron beam. As the vapor-phase MgO single crystal, an MgO single crystal having a cubic single crystal structure as illustrated in the SEM photograph in FIG. 5, and an MgO single crystal having a cubic polycrystal structure of cubic crystals fitted to each other as illustrated in the SEM photograph in FIG. 6 are included for example.

Then, the MgO layer 13 is formed by use of a method such as screen printing, offset printing, dispenser technique, ink-jet technique or a roll-coating technique to apply a coating of a paste including vapor-phase MgO single crystals as described above to the surfaces of the dielectric layer 12 and the additional dielectric layers 12A, or alternatively by use of a method such as spraying techniques, electrostatic spraying techniques to cause the vapor-phase MgO single crystals to adhere to the surfaces of the dielectric layer 12 and the additional dielectric layers 12A, or again by drying a coating of a paste including the vapor-phase MgO single crystal applied to a support film to form a film or a sheet shape and then laminating the film or sheet on the dielectric layer.

Figure 19:
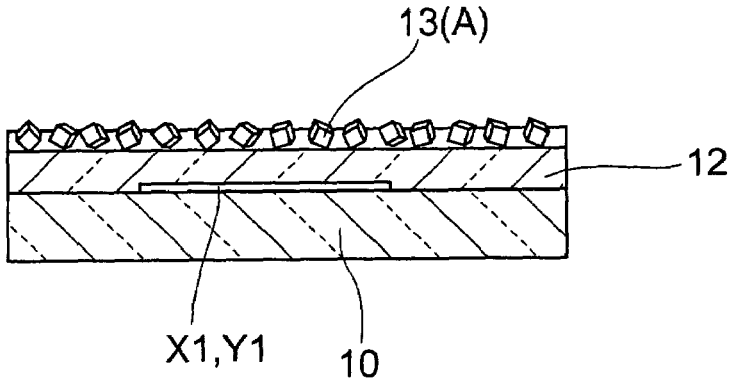
FIG. 19 is a sectional view illustrating the state of a magnesium oxide layer formed by a coating of a paste including magnesium oxide single crystals in the same example.

FIG. 19 shows the state when the MgO layer 13(A) is formed by use of a method such as screen printing, offset printing, dispenser technique, ink-jet technique or roll-coating technique to apply a coating of a paste including the vapor-phase MgO single crystals.

Figure 20:
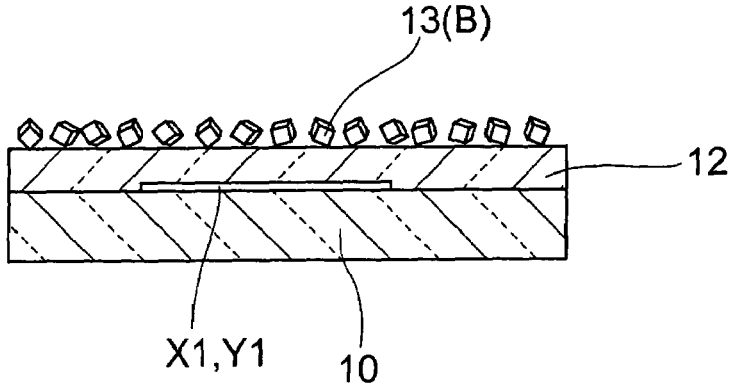
FIG. 20 is sectional view illustrating the state of a magnesium oxide layer consisting of a powder layer formed by a deposition of magnesium oxide single crystals in the same example.

Similarly, FIG. 20 shows the state when the MgO layer 13(B) is constituted of a powder layer formed by a deposition of powder of vapor-phase MgO single crystals by use of a method such as a spraying technique or electrostatic coating technique.

In the foregoing PDP, the speeding up of a discharge initiated in the discharge cell C3 (e.g. the speeding up of an address discharge by the long continuation of the priming effect resulting from a reset discharge) is achieved by forming an MgO layer 13 which includes MgO crystals causing CL emission having a peak within the wavelength from 200 nm to 300 nm upon being excited by electron beams.

Figure 21:
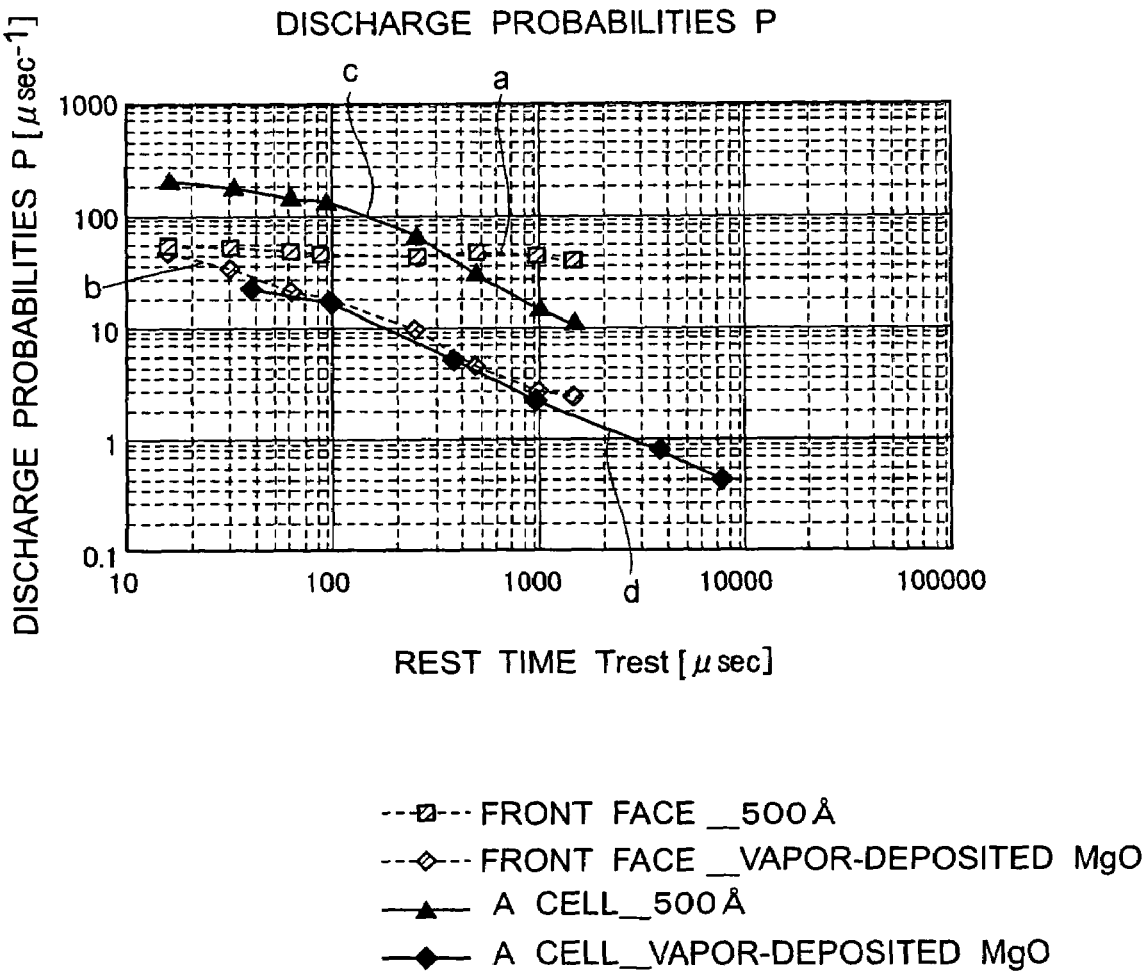
FIG. 21 is a graph showing the comparison between the discharge probability of the magnesium oxide layer consisting of a powder layer formed by a deposition of magnesium oxide single crystals in the same example and the discharge probability in another example.

FIG. 21 is a graph of the comparison between the discharge delay time in the case when a powder of MgO single crystals is dispersed in a medium such as a specific alcohol and then the suspension is sprayed to the surfaces of the dielectric layer 12 and the additional dielectric layers 12A by an air spray method using a spray gun to deposit the powder of MgO single crystals in order to form the MgO layer 13, and the discharge delay times in other examples.

In FIG. 21, the graph a shows the discharge probabilities when a powder layer formed of a powder of vapor-phase MgO single crystals of an average particle diameter of 500 angstroms is formed on the surface of the dielectric layer 12. The graph b shows the discharge probabilities when a conventional vapor deposition technique is used to form an MgO layer on the surface of the dielectric layer. The graph c shows the discharge probabilities when, as described in the first embodiment example, in a PDP of the type having the discharge cells each divided into a display discharge cell and an address discharge cell, an MgO layer is formed in the address discharge cell by application of a coating of a paste including a powder of vapor-phase MgO single crystals of an average particle diameter of 500 angstroms. The graph d shows the discharge probabilities when in an address discharge cell of a similar type, an MgO layer is formed by a conventional vapor deposition technique.

It is seen from the comparison between the graphs a and c in FIG. 21 that as regards the discharge probabilities (discharge delay) when the MgO layer 13 is constituted of a powder layer formed by a deposition of a powder of vapor-phase MgO single crystals, it is possible to provide the characteristics approximately equal to those in the case when the MgO layer is formed by application of a coating of a paste including the MgO single crystals.

It is further seen that, as compared with the case of an MgO layer formed by using a conventional vapor deposition technique, the discharge probabilities are greatly improved, either when, by use of the vapor-phase MgO single crystals of an average particle diameter of 500 angstroms, a coating is applied by a method such as screen printing, offset printing, dispenser technique, ink-jet technique or roll-coating technique to form an MgO layer, or when an MgO layer is formed by deposition using a method such as a spraying technique or electrostatic coating technique.

THIRD EMBODIMENT EXAMPLE

Figure 22:
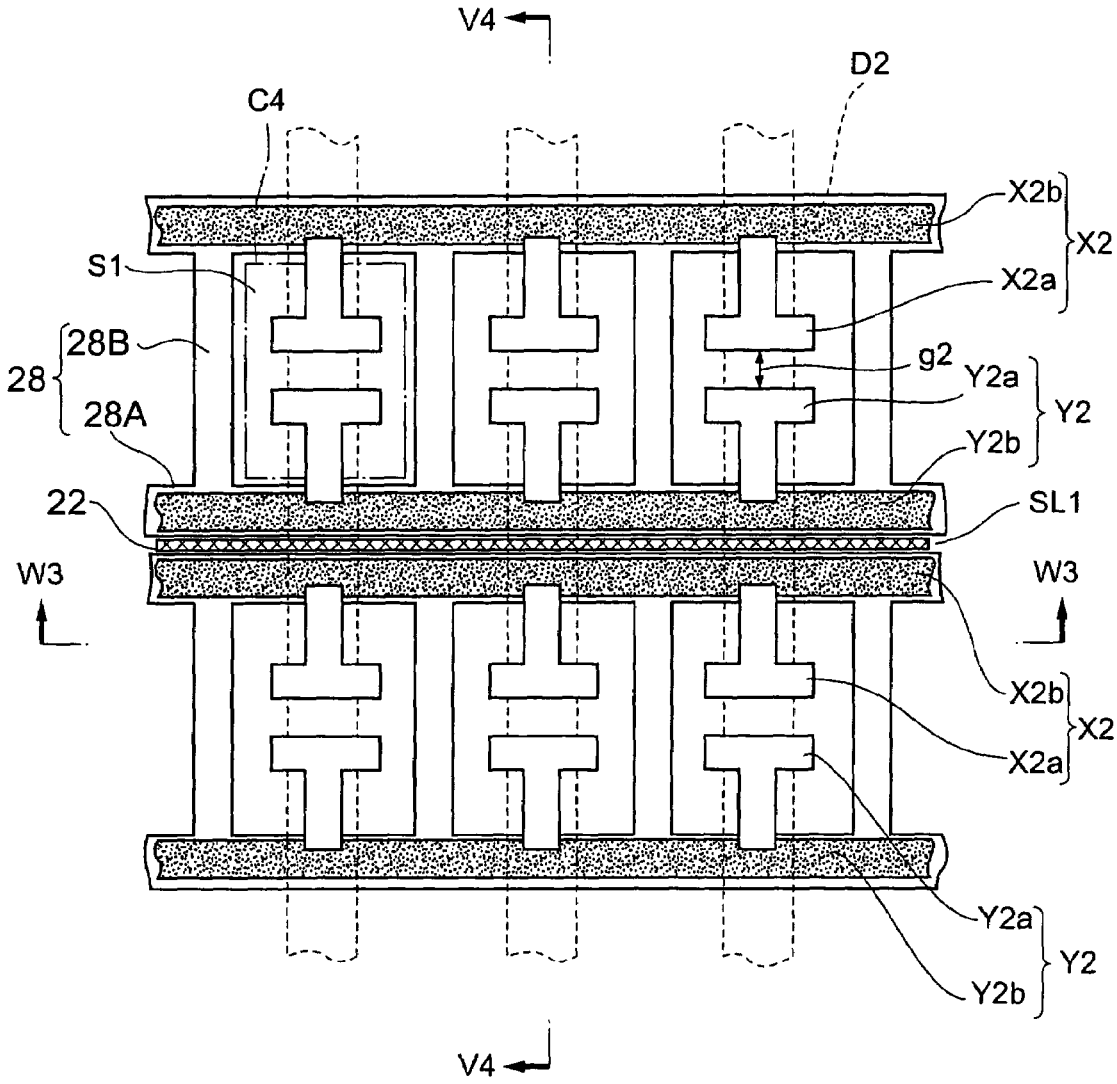
FIG. 22 is a front view illustrating a third embodiment example of an embodiment of the invention.
Figure 23:
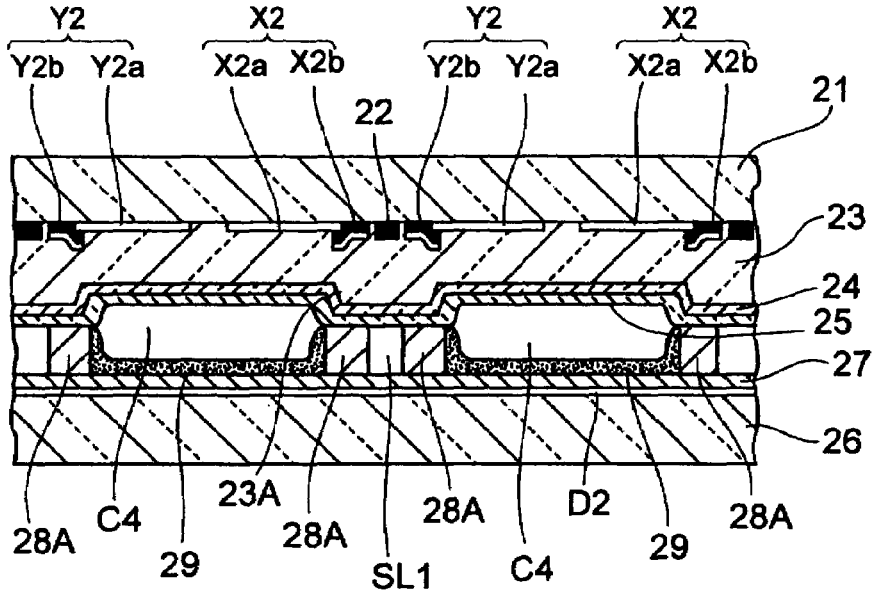
FIG. 23 is a sectional view taken along the V4-V4 line in FIG. 22.
Figure 24:
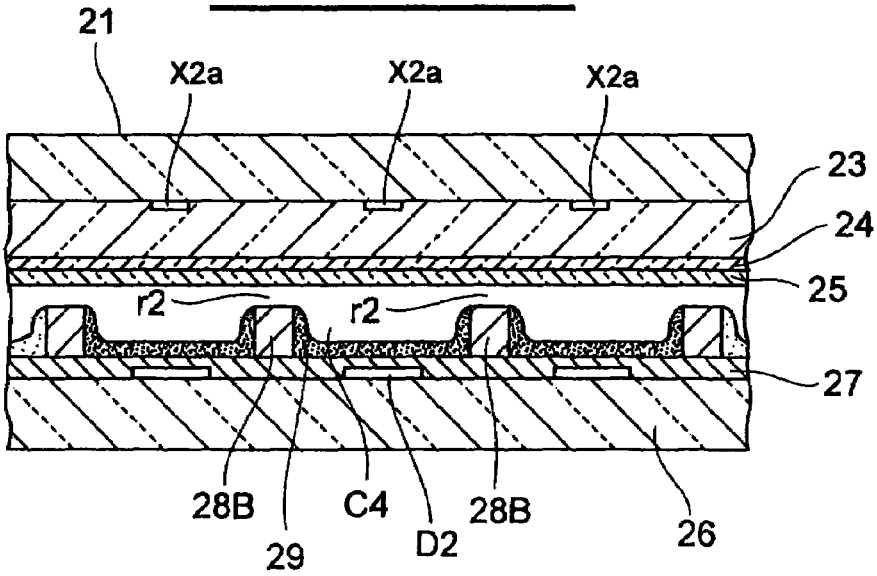
FIG. 24 is a sectional view taken along the W3-W3 line in FIG. 22.

FIGS. 22 to 24 illustrate a third embodiment example of an embodiment of the PDP according to the invention. FIG. 22 is a schematic front view of the PDP in the third embodiment example. FIG. 23 is a sectional view taken along the V4-V4 line in FIG. 22, and FIG. 24 is a sectional view taken along the W3-W3 line in FIG. 22.

The PDP shown in FIGS. 22 to 24 has a plurality of row electrode pairs (X2, Y2) arranged in parallel on a rear-facing face of a front glass substrate 21 serving as the display surface so as to extend in the row direction (the right-left direction in FIG. 22) of the front glass substrate 21.

A row electrode X2 is composed of T-shaped transparent electrodes X2*a* formed of a transparent conductive film made of ITO or the like, and a bus electrode X2*b* which is formed of a metal film and which extends in the row direction of the front glass substrate 21 and is connected to the narrow proximal ends of the transparent electrodes X2*a*.

A row electrode Y2, likewise, is composed of T-shaped transparent electrodes Y2*a* formed of a transparent conductive film made of ITO or the like, and a bus electrode Y2*b* which is formed of a metal film and which extends in the row direction of the front glass substrate 21 and is connected to the narrow proximal ends of the transparent electrodes Y2*a*.

The row electrodes X2 and Y2 are arranged in alternate positions in the column direction of the front glass substrate 21 (the vertical direction in FIG. 22). The transparent electrodes X2*a* and Y2*a*, which are regularly spaced along the associated bus electrodes X2*b* and Y2*b*, each extend out toward their counterparts in the row electrode pair, so that the wide distal ends of the transparent electrodes X2*a* and Y2*a* face each other across a discharge gap g2 of a required width.

Black or dark-colored light absorption layers (light-shield layers) 22 are each formed on the rear-facing face of the front glass substrate 21 between the back-to-back bus electrodes X2*b* and Y2*b* of the row electrode pairs (X2, Y2) adjacent to each other in the column direction, and extend along these bus electrodes X2*b*, Y2*b* in the row direction.

Further, a dielectric layer 23 is formed on the rear-facing face of the front glass substrate 21 so as to cover the row electrode pairs (X2, Y2). On the rear-facing face of the dielectric layer 23, additional dielectric layers 23A, which project backward from the dielectric layer 23, are each formed in a position opposite to the back-to-back bus electrodes X2*b* and Y2*b* of the row electrode pairs (X2, Y2) adjacent to each other and to the area between the above bus electrode X2*b* and the above bus electrode Y2*b* positioned back to back, so as to extend parallel to the bus electrodes X2*b*, Y2*b*.

In turn, on the rear-facing faces of the dielectric layer 23 and the additional dielectric layers 23A, an MgO layer (hereinafter referred to as "thin-film MgO layer") 24 of a thin film formed by vapor deposition or spattering is formed and covers the rear-facing faces of the dielectric layer 23 and the additional dielectric layers 23A.

An MgO layer (hereinafter referred to as "crystalline MgO layers") 25 including MgO crystals causing a cathode-luminescence emission (CL emission) having a peak within a wavelength range of 200 nm to 300 nm (in particular, around 235 nm, of 230 nm to 250 nm) upon excitation by electron beams as described in detail later is formed on the rear-facing face of the thin-film MgO layer 24.

The crystalline MgO layer 25 is formed on either the entire rear-facing face or a part of the rear-facing face of the thin-film MgO layer 24, for example a part facing a discharge cell which will be described later (in the example illustrated in the figures, the crystalline MgO layer 25 is formed on the entire rear-facing face of the thin-film MgO layer 24).

On the other hand, on the display-side face of the back glass substrate 26 placed parallel to the front glass substrate 21, column electrodes D2 are arranged in parallel to each other at predetermined intervals so as to extend in a direction at right angles to the row electrode pairs (X2, Y2) (the column direction) through positions opposite to the paired transparent electrodes X2*a* and Y2*a* in each row electrode pair (X2, Y2).

A white column-electrode protective layer (dielectric layer) 27 covering the column electrodes D2 is further formed on the display-side face of the back glass substrate 26, and in turn partition units 28 are formed on the column-electrode protective layer 27.

Each of the partition units 28 is formed in a ladder shape made up of a pair of transverse walls 28A extending in the row direction in the respective positions opposite to the bus electrodes X2*b* and Y2*b* of each row electrode pair (X2, Y2), and vertical walls 28B each extending in the column direction between the pair of transverse walls 28A in a mid-position between the adjacent column electrodes D2. The partition units 28 are regularly arranged in the column direction on either side of an interstice SL which extends in the row direction between the back-to-back transverse walls 28A of the adjacent partition units 28.

Then, the ladder-shaped partition units 28 partition the discharge space S1 between the front glass substrate 21 and the back glass substrate 26 into quadrangles respectively corresponding to discharge cells C4 formed in relation to the paired transparent electrodes X2*a* and Y2*a* in each row electrode pair (X2, Y2).

A phosphor layer 29 is formed on the side faces of the transverse walls 28A and the vertical walls 28B of the partition unit 28 and the face of the column-electrode protective layer 27 which face toward the discharge space S1, so as to cover all these five faces. The arrangement of the colors of the phosphor layers 29 is the three primary colors, red, green and blue, in sequence in the row direction in the respective discharge cells C4.

The crystalline MgO layer 25 (or the thin-film MgO layer 24 if the crystalline MgO layer 25 is formed only a portion of the rear-facing face of the thin-film MgO layer 24 facing each discharge cell C4) covering the additional dielectric layers 23A is in contact with the display-side faces of the transparent walls 28A of the partition units 28 (see FIG. 23), whereby each additional dielectric layer 23A blocks off the discharge cell C4 and the interstice SL from each other. However, the crystalline MgO layer 25 (or the thin-film MgO layer 24) is out of contact with the display-side face of the vertical wall 28B (see FIG. 24), to form a clearance r2 therebetween, so that the adjacent discharge cells C4 in the row direction communicate with each other by means of the clearance r2.

The discharge space S1 is filled with a discharge gas including xenon.

The crystalline MgO layer 25 is formed by depositing MgO crystals, as described earlier, to the surface of the rear-facing face of the thin-film MgO layer 24 covering the dielectric layer 23 and the additional dielectric layers 23A by a method such as a spraying technique or electrostatic coating technique.

Note that the embodiment example describes the case where the thin-film MgO layer 24 is formed on the rear-facing faces of the dielectric layer 23 and the additional dielectric layers 23A and then the crystalline MgO layer 25 is formed on the rear-facing face of the thin-film MgO layer 24. However, the thin-film MgO layer 24 may be formed on the rear-facing face of the crystalline MgO layer 25 after the crystalline MgO layer 25 may be formed on the rear-facing faces of the dielectric layer 23 and the additional dielectric layers 23A.

Figure 25:
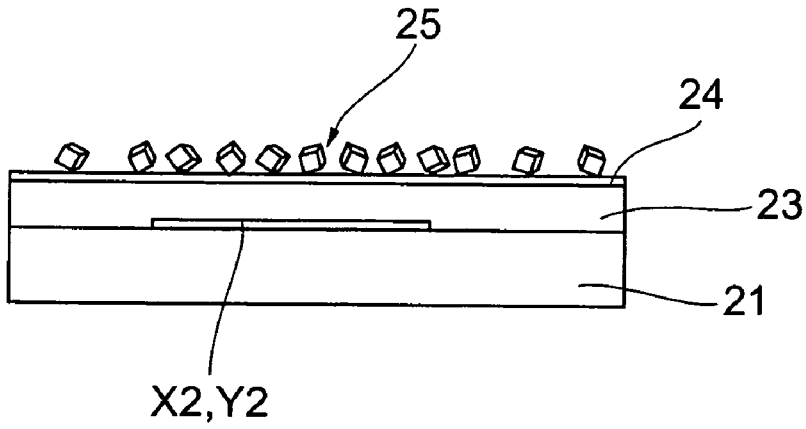
FIG. 25 is a sectional view illustrating the state of a crystalline magnesium oxide layer formed on a thin-film magnesium layer in the same example.

FIG. 25 illustrates the state when the thin-film MgO layer 24 is formed on the rear-facing face of the dielectric layer 23 and then MgO crystals are deposited to the rear-facing face of the thin-film MgO layer 24 to form the crystalline MgO layer 25 by use of a method such as a spraying technique or electrostatic coating technique.

Figure 26:
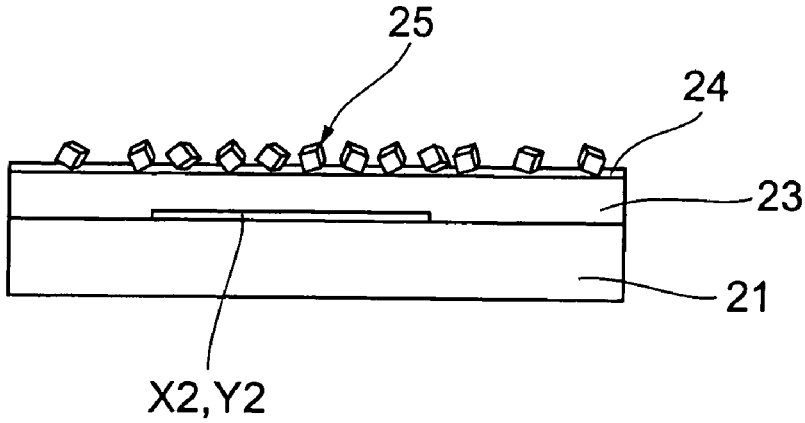
FIG. 26 is sectional view illustrating the state of a thin-film magnesium layer formed on a crystalline magnesium layer in the same example.

Also, FIG. 26 illustrates the state when MgO crystals are deposited to the rear-facing face of the dielectric layer 23 to form the crystalline MgO layer 25 by use of a method such as a spraying technique or electrostatic coating technique, and then the thin-film MgO layer 24 is formed.

The crystalline MgO layer 25 of the foregoing PDP is formed by use of the following materials and method.

Specifically, included among MgO crystals which are used as materials for forming the crystalline MgO layer 25 and causes CL emission having a peak within a wavelength range of 200 nm to 300 nm (in particular, around 235 nm, of 230 nm to 250 nm) upon being excited by an electron beam, is, for example, a single crystal of magnesium obtained by performing vapor-phase oxidation on magnesium steam generated by heating magnesium (this single crystal of magnesium is hereinafter referred to as "vapor-phase MgO single crystal"), as in the cases of the foregoing first and second embodiment examples. As the vapor-phase MgO single crystal, an MgO single crystal having a cubic single crystal structure as illustrated in the SEM photograph in FIG. 5, and an MgO single crystal having a structure of cubic crystals fitted to each other (i.e. a cubic polycrystal structure) as illustrated in the SEM photograph in FIG. 6 are included for example.

The vapor-phase MgO single crystal contributes to an improvement of the discharge characteristics such as a reduction in discharge delay as described later.

Further, as compared with MgO obtained by other methods, the vapor-phase MgO single crystal has the features of being of a high purity, taking a microscopic particle form, causing less particle agglomeration, and the like.

The vapor-phase MgO single crystal used in the embodiment example has an average particle diameter of 500 or more angstroms (preferably, 2000 or more angstroms) based on a measurement using the BET method.

For the sake of reference, the preparation of the vapor-phase MgO single crystal is described in "Preparation of magnesia powder using a vapor phase method and its properties" ("Zairyou (Materials)" vol. 36, no. 410, pp. 1157-1161, the November 1987 issue), and the like.

The crystalline MgO layer 25 is formed, for example, by depositing the vapor-phase MgO single crystal by use of a method such as a spraying technique or electrostatic coating technique, as described earlier.

In the above-mentioned PDP, a reset discharge, an address discharge and a sustaining discharge for generating an image are produced in the discharge cell C4.

Then, when the reset discharge is initiated in the discharge cell C4 prior to the initiation of the address discharge, the priming effect resulting from the reset discharge lasts for a long time because of the formation of the crystalline MgO layer 25 in the discharge cell C4, thereby speeding up of the address discharge.

In the above PDP, as illustrated in FIGS. 7 and 8 described earlier, the crystalline MgO layer 25 is formed of a vapor-phase MgO single crystal as described above, whereby the application of electron beams caused by the discharge excites, in addition to a CL emission having a peak within a wavelength range of 300 nm to 400 nm, a CL emission having a peak within a wavelength range of 200 nm to 300 nm (in particular, around 235 nm, of 230 nm to 250 nm) from the large-particle-diameter vapor-phase MgO single crystals included in the crystalline MgO layer 25. The greater the particle diameter of the vapor-phase MgO single crystal, the stronger the peak intensity of the CL emission having a peak within the wavelength range from 200 nm to 300 nm (in particular, around 235 nm, of 230 nm to 250 nm).

As shown in FIG. 9 described earlier, the CL emission with a peak at 235 nm is not excited from a MgO layer formed typically by vapor deposition (corresponding to the thin-film MgO layer 24 in this embodiment example), but only a CL emission having a peak wavelengths from 300 nm to 400 nm is excited.

It is conjectured that the presence of the CL emission having the peak wavelength from 200 nm to 300 nm will effect a further improvement of the discharge characteristics (a reduction in discharge delay, an increase in the probability of a discharge).

More specifically, the conjectured reason for the improvement of the discharge characteristics caused by the crystalline MgO layer 25 is because the vapor-phase MgO single crystals causing the CL emission having a peak within the wavelength range from 200 nm to 300 nm (in particular, around 235 nm, of 230 nm to 250 nm) have an energy level corresponding to the peak wavelength, so that the energy level enables the trapping of electrons for a long time (some msec. or more), and the trapped electrons are extracted by an electric field so as to serve as the primary electrons required for starting a discharge.

Therefore, the reason that the stronger the intensity of the CL emission having a peak within the wavelength range from 200 nm to 300 nm (in particular, around 235 nm, of 230 nm to 250 nm), the greater the improvement effects of the discharge characteristics caused by the vapor-phase MgO single crystal is as described in the aforementioned first embodiment example.

For the sake of reference, the particle diameter ($D_{BET}$) of the vapor-phase MgO single crystals forming the crystalline MgO layer 25 is calculated by the same method as that in the first embodiment example.

The correlation between the CL emission intensities and the discharge delay is, as is the case shown in FIG. 10 in the first embodiment example, that the display delay in the PDP is shortened by the 235 nm CL emission excited from the crystalline MgO layer 25, and further, as the intensity of the 235 nm CL emission increases, the discharge delay is shortened.

Figure 27:
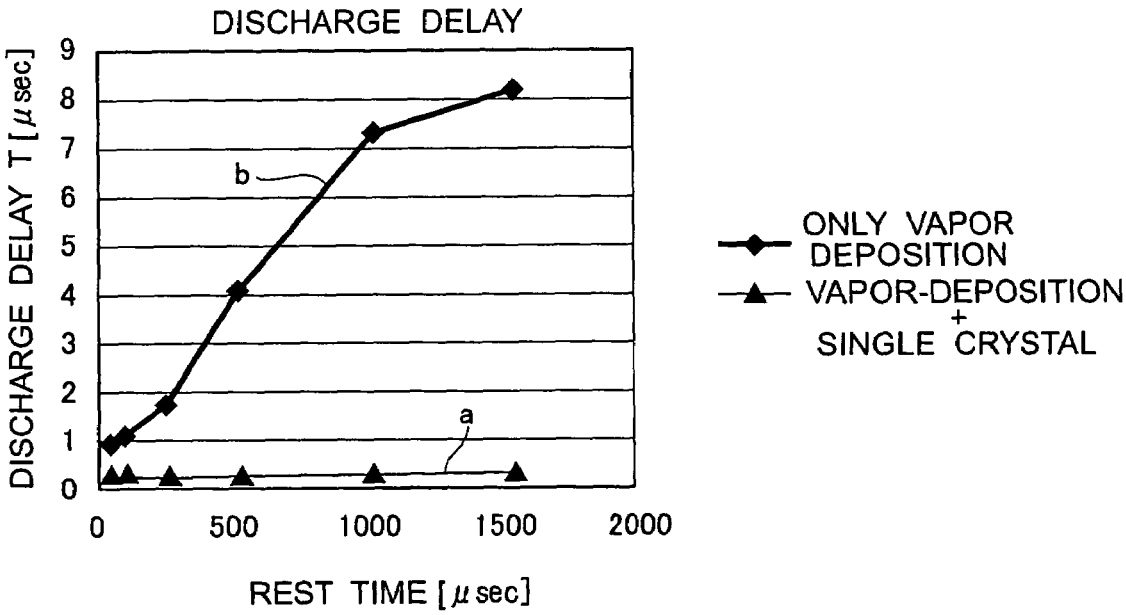
FIG. 27 is a graph showing the comparison of the discharge delay characteristics between the case when a protective layer is constituted only of a magnesium oxide layer formed by vapor deposition and that when a protective layer has a double layer structure made up of a crystalline magnesium layer and a thin-film magnesium layer formed by vapor deposition.

FIG. 27 shows the comparison of the discharge delay characteristics between the case of the PDP having the double-layer structure of the thin-film MgO layer 24 and the crystalline MgO layer 25 as described above (Graph a), and the case of a conventional PDP having only a MgO layer formed by vapor deposition (Graph b).

As seen from FIG. 27, it is seen that a PDP is provided with the double-layer structure of the thin-film MgO layer 24 and the crystalline MgO layer 25, whereby the discharge delay characteristics is significantly improved as compared with a conventional PDP having only a thin-film MgO layer formed by vapor deposition.

As described hitherto, by forming the crystalline MgO layers 25 including MgO crystals causing a CL emission having a peak within a wavelength range from 200 nm to 300 nm upon being excited by an electron beam in addition to the conventional thin-film MgO layer 24 formed by vapor deposition or the like, the above-described PDP is improved in the discharge characteristics such as the discharge delay, and is capable of showing satisfactory discharge characteristics.

As the MgO crystals forming the crystalline MgO layer 25, an MgO crystal of an average particle diameter of 500 or more angstroms based on a measurement using the BET method, preferably, of a range from 2000 angstroms to 4000 angstroms, is used.

The crystalline MgO layer 25 is not necessary required to be formed so as to cover the entire face of the thin-film MgO layer 24 as described earlier, and may be formed by patterning partially on portions facing the transparent electrodes X2*a*, Y2*a* of the row electrodes X2, Y2 or on portions excepting portions facing the transparent electrodes X2*a*, Y2*a*, for example.

When the crystalline MgO layer 25 is formed partially, the area ratio of the crystalline MgO layers 25 to the thin-film MgO layer 24 is set at from 0.1 to 85 percent.

For the sake of reference, the foregoing has described the case when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in positions corresponding to the intersections between row electrode pairs and column electrodes in the discharge space; a two-electrode AC PDP having discharge cells formed in positions corresponding to the intersections between row electrode pairs and column electrodes in the discharge space.

Further, the foregoing has described the case when the crystalline MgO layer 25 is formed through deposition by use of a method such as a spraying technique or an electrostatic coating technique. However, the crystalline MgO layer 25 may be formed through application of a coating of a paste including a powder of MgO crystals by use of a method such as a screen printing technique, an offset printing technique, a dispenser technique, an ink-jet technique of a roll-coating technique, or alternatively may be formed by applying a paste including MgO crystals to a support film, then drying it to a film and then laminating the film on the thin-film MgO layer.

INDUSTRIAL APPLICAPABILITY

The invention is useful to provide a PDP improved in discharge characteristics such as discharge probabilities and discharge delay to provide satisfactory discharge characteristics.

The invention claimed is:

1. A plasma display panel equipped with a front substrate and a back substrate facing each other across a discharge space, and with, between the front substrate and the back substrate, a plurality of row electrode pairs and a plurality of column electrodes extending in a direction intersecting the row electrode pairs to form unit light emitting areas in the respective portions of the discharge space corresponding to the intersections with the row electrode pairs, comprising:

on an area facing the unit light emitting area between the front substrate and the back substrate, a magnesium oxide layer that includes a magnesium oxide crystal capable of emitting a cathode-luminescence emission having a peak within a wavelength range of 200 nm to 300 nm upon being excited by electron beams, wherein the magnesium oxide crystal is exposed to the discharge space.

2. The plasma display panel according to claim 1, wherein the magnesium oxide crystal comprises a magnesium oxide single crystal produced by a vapor-phase oxidation technique.

3. The plasma display panel according to claim 1, wherein the magnesium oxide crystal is capable of emitting a cathode-luminescence emission having a peak within a range from 230 nm to 250 nm.

4. The plasma display panel according to claim 1, wherein the magnesium oxide crystal has a particle diameter of 2000 or more angstroms.

5. The plasma display panel according to claim 1, wherein the magnesium oxide layer is formed on a dielectric layer covering the row electrode pairs.

6. The plasma display panel according to claim 1, wherein the unit light emitting area is divided into a first light emitting area for causing light emission for forming an image and a second light emitting area for initiating a discharge for selecting the first light emitting area to cause the light emission for forming the image, and the magnesium oxide layer is provided in an area facing the second light emitting area of the unit light emitting area.

7. The plasma display panel according to claim 2, wherein the magnesium oxide single crystal comprises a magnesium oxide single crystal having a cubic single-crystal structure.

8. The plasma display panel according to claim 2, wherein the magnesium oxide single crystal comprises a magnesium oxide single crystal having a cubic polycrystal structure.

9. The plasma display panel according to claim 2, wherein the magnesium oxide single crystal has a particle diameter of 500 or more angstroms.

10. The plasma display panel according to claim 2, wherein the magnesium oxide single crystal has a particle diameter of 2000 or more angstroms.

11. The plasma display panel according to claim 1, comprising a dielectric layer covering either the row electrode pairs or the column electrodes, and a protective layer covering the dielectric layer, wherein the magnesium oxide layer, which includes the magnesium oxide crystal capable of emitting a cathode-luminescence emission having a peak within a wavelength range of 200 nm to 300 nm upon being excited by electron beams, constitutes the protective layer of a lamination structure, together with a thin-film magnesium oxide layer formed by vapor deposition or spattering.

12. The plasma display panel according to claim 11, wherein the thin-film magnesium oxide layer is formed on the dielectric layer, and the magnesium oxide layer including the magnesium oxide crystal is formed on the thin-film magnesium oxide layer.

13. The plasma display panel according to claim 11, wherein the magnesium oxide layer including the magnesium oxide crystal is formed on the dielectric layer, and the thin-film magnesium oxide layer is formed on the magnesium oxide layer including the magnesium oxide crystal.

14. The plasma display panel according to claim 11, wherein the magnesium oxide layer including the magnesium oxide crystal and the thin-film magnesium oxide layer are individually formed on the entire surface of the dielectric layer.

15. The plasma display panel according to claim 11, wherein the thin-film magnesium oxide layer is formed on the entire surface of the dielectric layer, and the magnesium oxide layer including the magnesium oxide crystal is formed in a position opposite to a part of the surface of the dielectric layer.

16. The plasma display panel according to claim 15, wherein the magnesium oxide layer including the magnesium oxide crystal is formed on a portion facing either the row electrode pair or the column electrode.

17. The plasma display panel according to claim 15, wherein the magnesium oxide layer including the magnesium oxide crystal is formed on a portion excepting a portion facing either the row electrode pair or the column electrode.

18. The plasma display panel according to claim 1, wherein the magnesium oxide crystal is oriented at random in the magnesium oxide layer.

19. A method of manufacturing a plasma display panel equipped with a front substrate and a back substrate facing each other across a discharge space, electrodes formed on at least one of the front and back substrates, a dielectric layer covering the electrodes, and a protective layer covering the dielectric layer, comprising:

forming a magnesium oxide layer that includes a magnesium oxide crystal capable of emitting a cathode-luminescence emission having a peak within a wavelength range of 200 nm to 300 nm upon being excited by electron beams, in a position covering a required portion of the dielectric layer, wherein the magnesium oxide crystal is exposed to the discharge space.

20. The method of manufacturing the plasma display panel according to claim 18, wherein in the forming the magnesium oxide, a coating of a paste including the magnesium oxide crystal is applied to a required portion of the dielectric layer to form the magnesium oxide layer.

21. The method of manufacturing the plasma display panel according to claim 19, wherein in the forming the magnesium oxide, a powder of the magnesium oxide crystal is sprayed and deposited on the dielectric layer to form the magnesium oxide layer.

22. The method of manufacturing the plasma display panel according to claim 19, wherein the magnesium oxide crystal comprises a magnesium oxide single crystal produced by a vapor-phase oxidation technique.

23. The method of manufacturing the plasma display panel according to claim 19, wherein the magnesium oxide crystal is capable of emitting a cathode-luminescence emission having a peak within a range from 230 nm to 250 nm.

24. The method of manufacturing the plasma display panel according to claim 19, wherein the magnesium oxide crystal has a particle diameter of 2000 or more angstroms.

25. The method of manufacturing the plasma display panel according to claim 22, wherein the magnesium oxide single crystal comprises a magnesium oxide single crystal having a cubic single-crystal structure.

26. The method of manufacturing the plasma display panel according to claim 22, wherein the magnesium oxide single crystal comprises a magnesium oxide single crystal having a cubic polycrystal structure.

27. The method of manufacturing the plasma display panel according to claim 22, wherein the magnesium oxide single crystal has a particle diameter of 500 or more angstroms.

28. The method of manufacturing the plasma display panel according to claim 22, wherein the magnesium oxide single crystal has a particle diameter of 2000 or more angstroms.

29. The method of manufacturing the plasma display panel according to claim 19, wherein, in forming the protective layer, the forming the magnesium oxide layer is performed together with forming a thin-film magnesium oxide layer by vapor deposition or spattering to form the protective layer of a lamination structure made up of the thin-film magnesium oxide layer and the magnesium oxide layer including the magnesium oxide crystal.

30. The method of manufacturing the plasma display panel according to claim 29, wherein after the forming the thin-film magnesium oxide layer has been performed, the forming the magnesium oxide layer including the magnesium oxide crystal is performed.

31. The method of manufacturing the plasma display panel according to claim 29, wherein after the forming the magnesium oxide layer including the magnesium oxide crystal is performed, the forming the thin-film magnesium oxide layer is performed.

32. The method of manufacturing the plasma display panel according to claim 29, wherein in the forming the protective layer, the magnesium oxide layer including the magnesium oxide crystal and the thin-film magnesium oxide layer are individually formed on the entire surface of the dielectric layer.

33. The method of manufacturing the plasma display panel according to claim 29, wherein in the forming the thin-film magnesium oxide layer, the thin-film magnesium oxide layer is formed on the entire surface of the dielectric layer, and in the forming the magnesium-oxide layer including the magnesium oxide crystal, the magnesium oxide layer including the magnesium oxide crystal is formed in a position opposite to a part of the surface of the dielectric layer.

34. The method of manufacturing the plasma display panel according to claim 33, wherein in the forming the magnesium oxide layer including the magnesium oxide crystal, the magnesium oxide layer including the magnesium oxide crystal is formed on a portion facing the electrodes.

35. The method of manufacturing the plasma display panel according to claim 33, wherein in the forming the magnesium oxide layer including the magnesium oxide crystal, the magnesium oxide layer including the magnesium oxide crystal is formed on a portion excepting a portion facing the electrodes.

* * * * *